United States Patent [19]

Culpepper

[11] Patent Number: 4,642,967

[45] Date of Patent: Feb. 17, 1987

[54] PACKAGING MACHINE

[75] Inventor: Will L. Culpepper, Tucker, Ga.

[73] Assignee: The Mead Corporation, Dayton, Ohio

[21] Appl. No.: 507,860

[22] Filed: Jun. 27, 1983

[51] Int. Cl.[4] ..... B65B 35/44; B65B 49/02

[52] U.S. Cl. ..... 53/398; 53/543; 53/580; 53/201; 53/207; 53/209; 53/381 R; 53/534; 198/425; 198/458; 198/473.1; 198/803.01; 493/179; 493/438

[58] Field of Search ..... 53/381 R, 491, 207, 53/209, 462, 534, 543, 580, 201, 398; 493/179, 182, 183, 438, 453, 455, 178; 198/425, 458, 473.1, 653

[56] References Cited

U.S. PATENT DOCUMENTS

| | | | |
|---|---|---|---|
| 2,261,018 | 10/1941 | Chapman | 493/438 |
| 2,932,929 | 4/1960 | Fahrenbach | 53/580 X |
| 3,194,382 | 7/1965 | Nigrelli | 53/543 |
| 3,454,149 | 7/1969 | Nigrelli | 53/543 X |
| 3,995,539 | 12/1976 | Wallin | 493/182 X |

FOREIGN PATENT DOCUMENTS

| | | | |
|---|---|---|---|
| 2550258 | 5/1977 | Fed. Rep. of Germany | 53/207 |

*Primary Examiner*—John Sipos
*Attorney, Agent, or Firm*—B. J. Powell

[57] ABSTRACT

Apparatus for loading articles into trays where the articles are first separated into rows with a divider assembly, then separated into groups with a grouper assembly and then pushed onto a dead plate to form a load. Different divider and grouper assemblies are provided to make different load configurations. A tray blank is moved under the dead plate and pushed out from under the dead plate synchronously with the movement of the article load over the dead plate so that the article load is deposited on the tray blank. Thereafter, the flaps on the tray blank are folded to erect the tray around the group of articles. Mechanical folding mechanisms are provided to fold certain of the flaps on the tray without folding the other flaps. The method of loading the articles in the tray and forming the tray around the articles is also disclosed.

11 Claims, 19 Drawing Figures

PACKAGING MACHINE

BACKGROUND OF THE INVENTION

This invention relates generally to the packaging of groups of articles in open top paperboard trays in order to be capped by plastic film to maintain package integrity. More particularly, the invention is concerned with the loading of the articles in the tray and the erection of the tray around the articles.

Packaging systems which erect open top paperboard trays from precut tray blanks and load articles into the tray, usually before or during the erection of the tray, are commonly known as tray former/loaders. One of the basic problems associated with these prior art tray former/loaders is that adjustment thereof to load different size articles and/or to load the articles in different group configurations is typically difficult and time consuming. As a result, these prior art tray former/loaders did not lend themselves to use in situations which required frequent changeovers to different group configurations and/or different size articles. Moreover, it has been difficult, especially in high speed operation, to insure registration between the load of articles and the tray during the loading operation. Yet another problem associated with these prior art tray former/loaders is that, especially in high speed operation, it is difficult to get good tray formation around the articles.

SUMMARY OF THE INVENTION

These and other problems and disadvantages associated with the prior art are overcome by the invention disclosed herein by providing a tray former/loader for a packaging system which has the capability of being quickly and easily changed to accommodate different group configurations and/or different size articles to be loaded in the trays. Further, the tray blank and the group of articles being loaded onto the tray blank are positively and synchronously moved during the loading operation to insure registration between the load of articles and tray. The erection of the tray around the articles is positively controlled so as to insure good tray formation and prevent damage to the tray during the erection process.

The apparatus of the invention includes an infeed section which arranges the articles to be in parallel rows, a grouper section which subdivides the rows into subgroups and a loading section which combines the subgroups in the rows into a load and pushes the load over the downstream edge of a dead plate. At the same time, a blank feeder section feeds a tray blank under the dead plate onto a tray conveyor which moves the tray blank out from under the dead plate synchronously with the movement of the article load so that the article load is placed on the tray bottom panel. The article load is released so that it is moved with the tray blank by the tray conveyor. Front and rear flap folders fold the flaps on opposite ends of the side walls into a square condition. The loaded tray then passes through an erection section which finishes erecting the tray around the article load. Complementary upper and lower land divider assemblies are removably mounted in the infeed, grouper and loading sections to divide the articles into the rows. Different numbers of rows and/or different article sizes can be easily accommodated by interchanging matched sets of divider assemblies. A different grouper conveyor is removably mounted in the grouper section for each different lane divider assembly set. As a result, changeovers between different articles and/or groupings is reduced to a minimum. Because both the article load and the tray blank are positively and synchronously driven, registration of the load on the tray is assured.

These and other features and advantages of the invention disclosed herein will become more apparent upon consideration of the following specification and accompanying drawings wherein like characters of reference designate corresponding parts throughout the several views and in which:

BRIEF DESCRIPTION OF THE DRAWINGS

FIG. 9 is an enlarged top plan view of the grouper section illustrating an alternate grouping arrangement;

These figures and the following detailed description disclose specific embodiments of the invention; however, it is to be understood that the inventive concept is not limited thereto since it can be incorporated in other forms.

DETAILED DESCRIPTION OF ILLUSTRATIVE EMBODIMENTS

Figure 1:
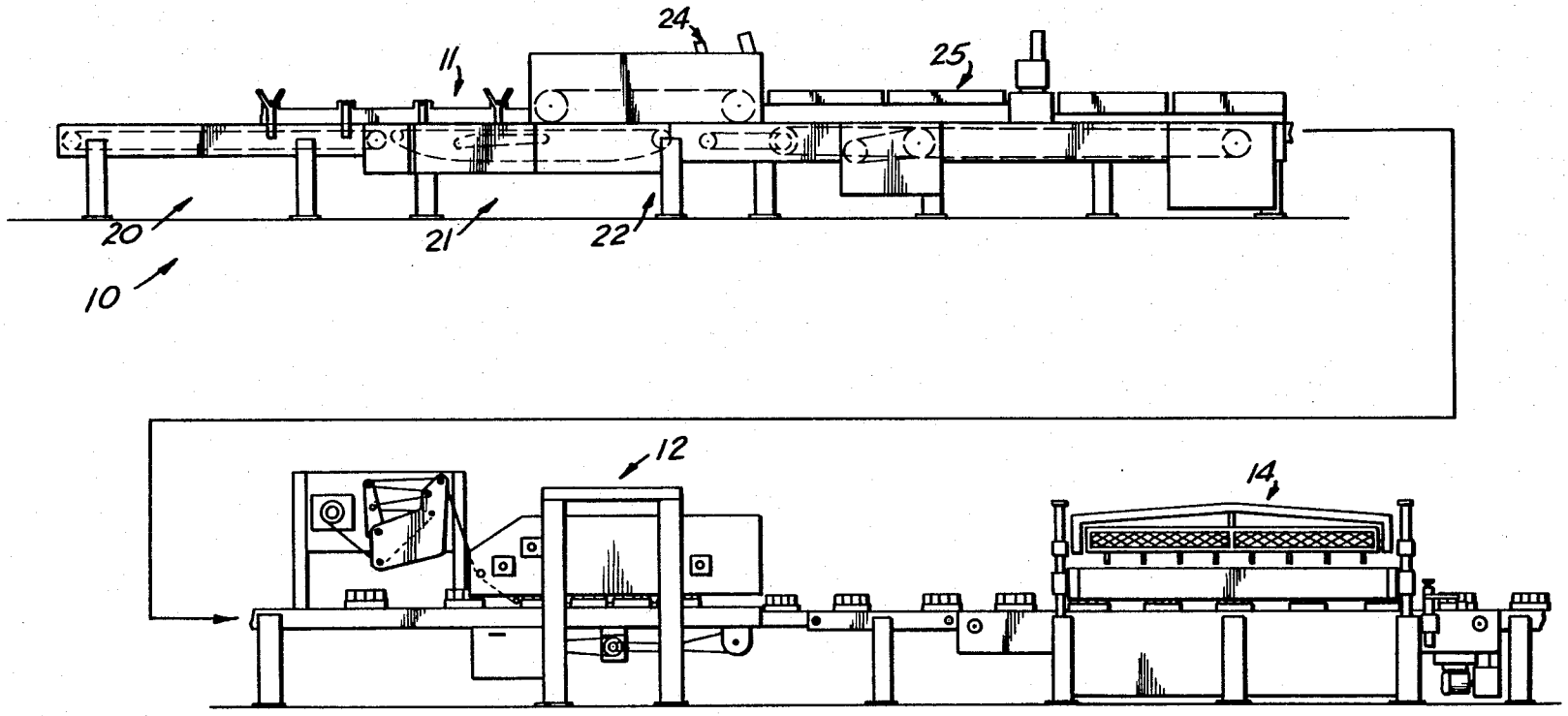
FIG. 1 is a schematic view illustrating a packaging system incorporating the invention.

The invention is incorporated in a packaging system 10 schematically illustrated in FIG. 1 which includes a tray former/loader 11 for erecting and loading paperboard trays with articles such as cans, bottles, and the like; a film wrapper 12 for applying a sheet of plastic film over the tops of the articles in the tray and attaching the film to opposite tray side walls; and a shrink tunnel 14 for shrinking the film and forming a tight package. The tray former/loader 11 is designed for rapid changeover in order to accommodate articles of different diameters and heights and to arrange these articles into groups or loads of different configurations. Typical of the load configurations loaded in the tray former/loader 11 includes loads of 24 articles arranged in a 6×4 configuration; 12 articles arranged in a 4×3 configuration; and six articles arranged in a 3×2 configuration. Within each of these configurations, several different diameters of articles can be packaged.

The tray former/loader 11 includes an infeed section 20 for receiving the articles from a conventional supply and for arranging the articles in a plurality of parallel rows, a grouper section 21 for separating the articles in each row into subgroups, a loading section 22 for combining the subgroups of articles in the rows into a load of articles of the desired configuration and moving the load of articles onto a tray blank to load same, a blank feeder section 24 for holding a supply of tray blanks and feeding the tray blanks one at a time to the loading section 22, and a tray erection section 25 for receiving the tray blank with the load of articles therein erecting the tray around the load of articles. It will be appreciated that the articles move in a rectilinear processing path longitudinally through the machine while the tray blanks are first moved from a position laterally of the article path into registration with the articles moving along the path and then moved with the articles along the rectilinear processing path through the machine.

Figure 3:
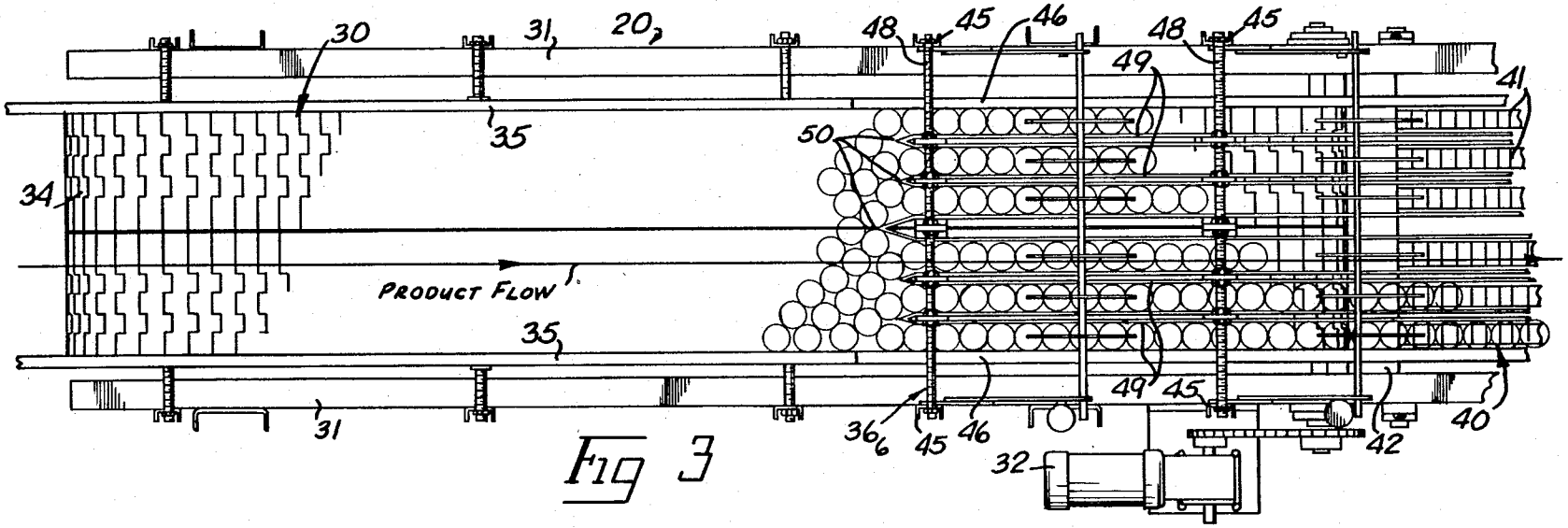
FIG. 3 is a top plan view of the infeed section of the tray former/loader.
Figure 4:
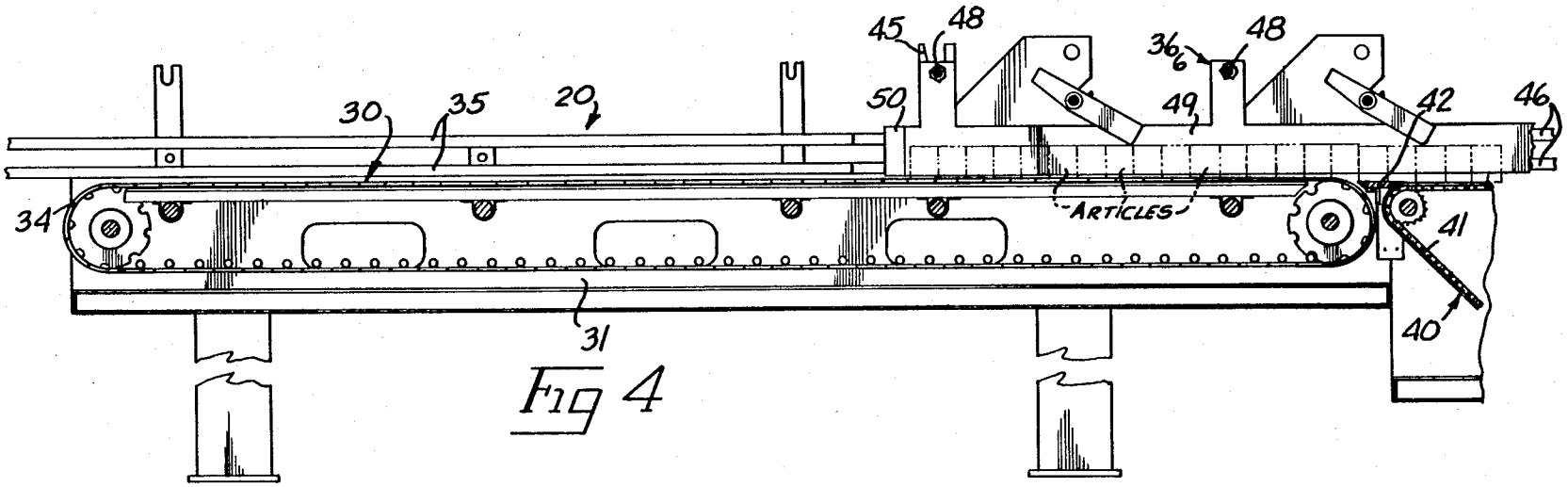
FIG. 4 is a longitudinal cross-sectional view of the infeed section of FIG. 3.

As best seen in FIGS. 3 and 4, an infeed conveyor 30 is provided in the infeed section 20 and is mounted between the machine side frames 31 so that it extends longitudinally of the machine and is driven from a drive motor 32 so that its upper flight moves from the left to the right as seen in FIGS. 3 and 4. The conveyor 30 forms a smooth transport surface on its upper flight so that the articles can ride therewith but the movement of the articles can be arrested when they strike an obstacle while the conveyor 30 slides under the articles and still supports them. The articles to be packaged are deposited on the upstream infeed end 34 (the left end as seen in FIGS. 3 and 4) from a conventional well known supply to be transported by the conveyor 30. A pair of side guides 35 are adjustably mounted on the machine side frames 31 on opposite sides of the upper flight of the conveyor 30 to keep the articles on the conveyor 30. The side guides 35 extend from the upstream end 34 of conveyor 30 to positions intermediate the length of the conveyor 30 as will become more apparent. As is common in the packaging industry, the conveyor 30 is operated so that the space between the side guides 35 is filled with the articles riding on top of the conveyor 30 in an unordered configuration.

An upper lane divider assembly 36 seen in FIGS. 3–6 is positioned over the infeed conveyor 30 immediately downstream of the side guides 35. The land divider assembly 36 extends past the discharge end of the conveyor 30 and through the grouper section 21 to separate the unordered configuration of articles moving down conveyor 30 into a plurality of ordered separate and parallel rows as will become more apparent.

A lane conveyor 40 is positioned below the lane divider assembly 36 at the discharge end of the infeed conveyor 30 for transporting the different rows of articles through the grouper section 21. The lane conveyor 40 includes a plurality of lane conveyor chains 41 with all of the conveyor chains 41 trained around sprockets on common spaced apart support shafts so that the chains 41 are located in longitudinally aligned but laterally spaced apart parallel positions. The upper flights of the chains 41 are coplanar with the upper flight of the infeed conveyor 30 and receive the articles from conveyor 30 over a side plate 42. The number of chains 41 corresponds to the maximum number of rows of articles to be incorporated in a tray load. In the machine illustrated, six rows of articles are the maximum number of rows which are to be loaded so there are six chains 41. Each of the chains 41 has a transverse width smaller than the smallest diameter article to be packaged as will become more apparent. The chains 41 are constructed so that their upper flights are smooth in order that the articles will ride therewith until an obstacle stops the article and the chain 41 can continue to run under the article. The two center chains 41 are spaced apart a distance $d_1$ to define the space $S_W$ therebetween while the spacing between the rest of the chains is at distance $d_2$ less than distance $d_1$ to define spaces $S_N$ therebetween. This allows the size of articles that can be handled as well as the load configuration to be changed without having to adjust the lateral spacing between the lane conveyor chains 41. As a result, changeover for different sizes of articles or different load configurations is greatly facilitated as will become more apparent.

The upper lane divider assembly 36 is removably mounted in uprights 45 on the machine side frames 31. A plurality of lane divider assemblies 36 are provided with each divider assembly adjusted for a different size article and/or a different load configuration. Three different divider assemblies 36 are shown in the drawings for purposes of illustration for use with six, four and three row loads. These different divider assemblies 36 have been further designated $36_6$ for the six row version seen in FIGS. 5–8, $36_4$ for the four row version seen in FIGS. 11 and 12, and $36_3$ for the three row version seen in FIGS. 13 and 14. Each of the different divider assemblies 36 align the different rows or articles with certain of the chains 41 so that the articles ride on the chains 41 through the grouper section 21 and into the loading section 22.

Each divider assembly 36 has a pair of opposed side guides 46 depending from the transversely extending support rods 48 with the support rods 48 removably mounted in the uprights 45 to fix the assembly 36 laterally of the chains 41. A plurality of line divider plate units 49 depends from the support rods 48 between the side guides 46. The line divider plate units 49 vary in transverse width in order that the articles can be transversely aligned with the conveyor chains 41. The number of line divider plate units 49 varies depending on the number of rows or articles to be used. For instance, the assembly $36_6$ has five plate units 49, the assembly $36_4$ has three plate units 49, and the assembly $36_3$ has two plate units 49. The plate units 49 are appropriately tapered on their upstream ends as indicated at 50 in FIGS. 3 and 4 to force the articles into the separate rows.

Figure 5:
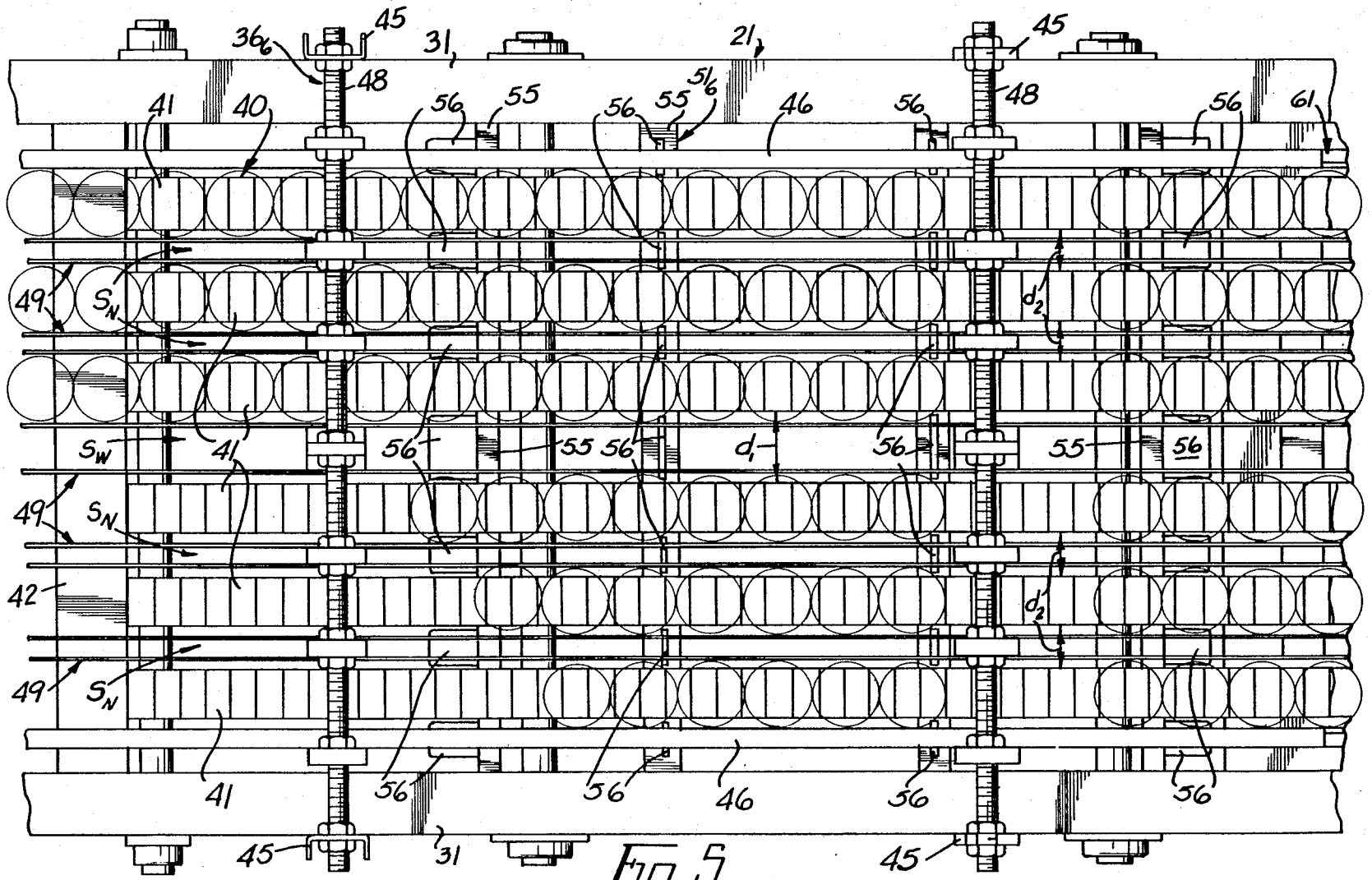
FIG. 5 is an enlarged top plan view of the grouper section.

As best seen in FIG. 5, the divider assembly $36_6$ centers a row of articles over each of the lane conveyor chains 41. The distance $d_2$ across space $S_N$ is selected so that the largest diameter articles in a six row load can be centered on the adjacent chains 41 when the plate units 49 between these chains are single thin plates. Since the articles illustrated are less than the maximum acceptable diameter, the plate units 49 illustrated in FIGS. 3–6 each have two spaced apart plates.

As best seen in FIG. 9, the divider assembly $36_4$ centers a row of articles over each of the two center chains 41 and a row of articles over each of the outboard chains 41 while leaving the two chains between the center and outboard chains vacant. The distance $d_1$ across space $S_W$ is selected so that the largest diameter articles in a four row load can be centered on the two center chains 41 when the center plate unit 49 is a single plate as illustrated in FIG. 9.

Figure 11:
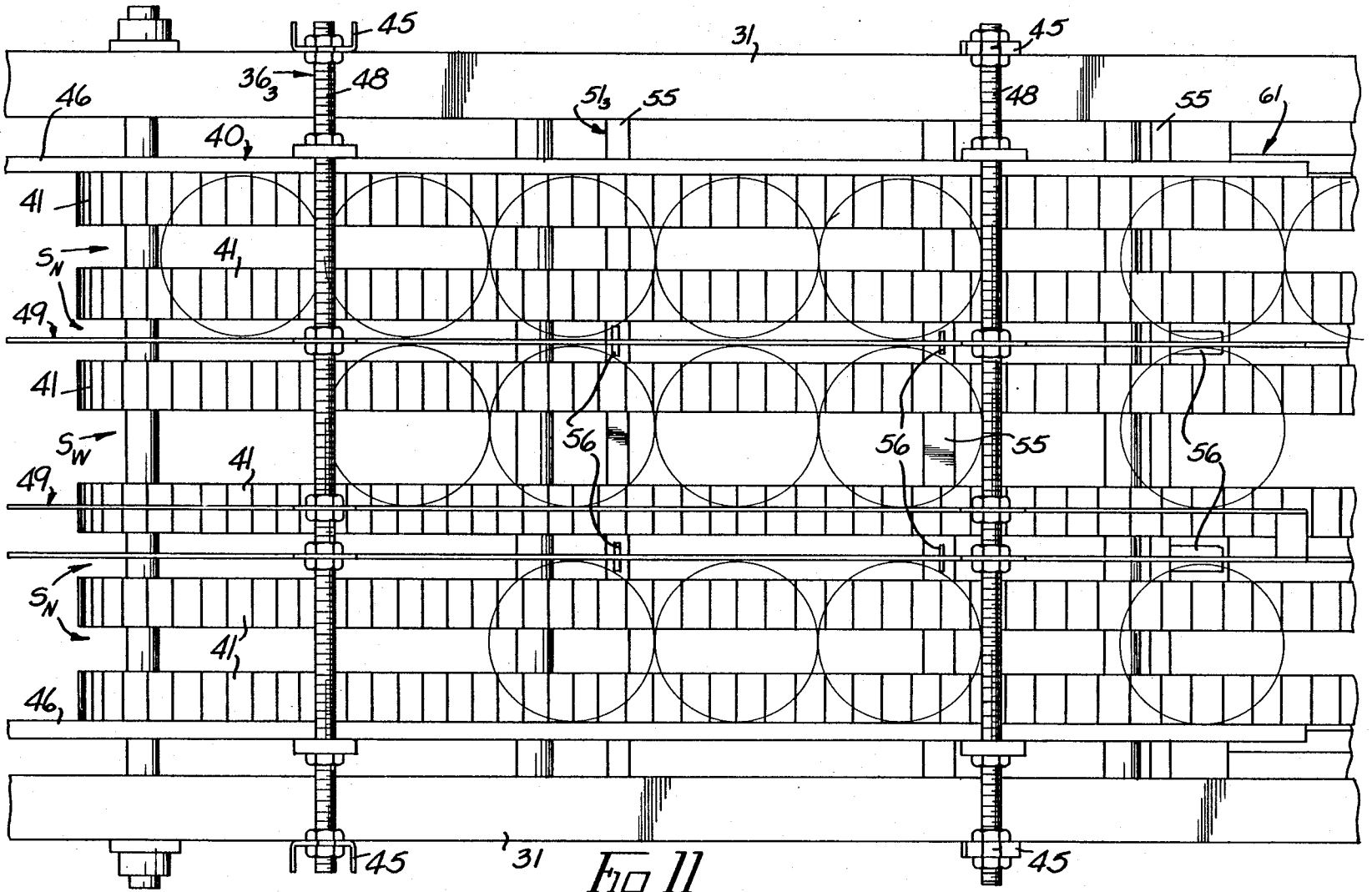
FIG. 11 is an enlarged top plan view of the grouper section illustrating another alternate grouping arrangement.

As best seen in FIG. 11, the divider assembly $36_3$ locates the articles so that each row is carried by two chains 41. The rows are offset so that each row projects out over the spaces $S_N$ between chains 41.

Figure 6:
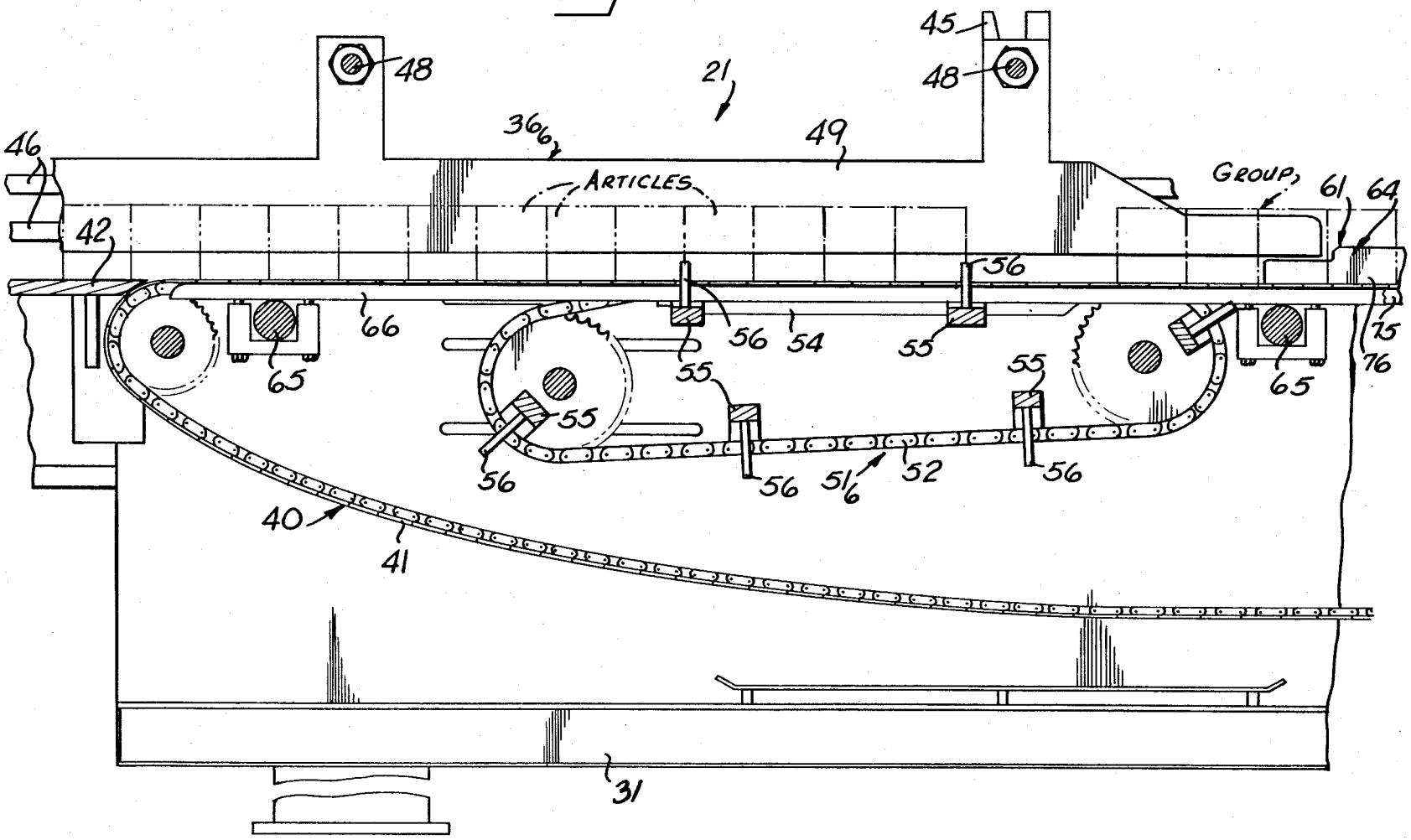
FIG. 6 is a longitudinal cross-sectional view of the grouper section.

To separate the articles in each row into subgroups, a grouper conveyor 51 is provided in the grouper section 21 below the upper flights of the lane conveyor change 41 as best seen in FIGS. 5 and 6. The grouper conveyor 51 includes a pair of spaced apart chains 52 which are trained around sprockets located on opposite sides of the lane conveyor 40 outboard of the outboard conveyor chains 41. The upper flights of the grouper chains 52 pass upwardly from the sprocket at the upstream end of the chains 52 and then along a guide 54 which keeps the upper flights of the chains 52 generally horizontally aligned with the upper flights of the conveyor chains 41. The grouper chains 52 mount a plurality of flight bars 55 therebetween so that the flight bars 55 are oriented generally transversely of the lane conveyor chains 41 and pass along just under the lane conveyor chains 41 as the flight bars 55 move along the upper flights of the grouper chains 52. Each of the flight bars 55 is equipped with a plurality of holdback tabs 56 that project up through the spaces $S_W$ and/or $S_N$ between the lane conveyor chains 41 as the flight bars 55 move along the upper flights of the grouper chains 52 as best seen in FIGS. 5 and 6.

It will be appreciated that the grouper conveyor chains 52 are removably mounted on the sprockets of conveyor 51 so that they can be quickoy removed and replaced. Like the lane divider assemblies 36, there are a plurality of grouper conveyors 51 with each grouper conveyor matching one of the lane divider assemblies 36 and designed to handle a different size article and/or a different load configuration as will become more apparent. Three different grouper conveyors 51 are illustrated that match assemblies $36_6$, $36_4$ and $36_3$ for use with six, four and three row loads and these different grouper conveyors have been further designated as $51_6$ for the six row version, $51_4$ for the four row version, and $51_3$ for the three row version. The grouper conveyor $51_6$ divides each row into subgroups of four articles each while the conveyor $51_4$ divides each row into subgroups of three articles each and while the conveyor $51_3$ divides each row into subgroups of two articles each.

As seen in FIGS. 5 and 6, the six row grouper conveyor $51_6$ has seven holdback tabs 56 thereon which project up through the spaces $S_W$ and $S_N$ so that opposite edges of each of the tabs 56 are located adjacent one of the conveyor chains 41. It will be appreciated that the bottom of the side guides 46 and line divider plate units 49 are located high enough above the surface of the lane conveyor chains 41 to clear the tops of the holdback tabs 56. It will also be appreciated that the articles in each row of articles project out laterally on opposite sides of the conveyor chain 41. Since the articles are cylindrical, those portions of the articles projecting out over opposite sides of the conveyor chains 41 are spaced from each other even though the articles in the row abut. The spacing between the flight bars 55 is such that the holdback tabs 56 will project up between the leading and trailing article in each subgroup to be formed in the row. The tabs 56 project into the space between the articles overhanging opposite edges of the chains 41 so that the holdback tabs 56 will engage opposite sides of the leading articles in each subgroup. This allows the subgroup of articles immediately preceding the row of articles being held back by the tabs 56 to be moved away from the articles being held back to allow the subgroup to be separated from the row of articles held back by the tabs 56. It will be appreciated that the grouper conveyor $51_6$ is moving more slowly than the conveyor chains 41 so that when the holdback tabs 56 engage the articles, the subgroup released will move away from the row being held back by the tabs 56. The upper flights of the grouper chains 52 are sufficiently long for the holdback tabs 56 on the next downstream flight bar 55 into the space between the articles in the row for the formation of the next subgroup prior to the time the holdback tab 56 actually holding back the row of articles releases the articles. It will be appreciated that the holdback tabs 56 move up between the bottoms of the articles onto chains 41 as the flight bars 55 move up from the sprocket at the upstream end of the conveyor $51_6$ onto guides 54.

As seen in FIG. 9, the holdback tabs 56 on the four row grouper conveyor $51_4$ are located so that they project up through the spaces $S_W$ and $S_N$ on opposite sides of the two center lane conveyor chains 41 and on opposite sides of the two outboard conveyor chains 41. Since the grouper conveyor $51_4$ is designed to separate the rows of articles into subgroups of three articles deep, the spacing between the flight bars 55 is such that the holdback tabs 56 will project up between the conveyor chains 41 in every third space between the articles in the row that project outwardly on opposite sides of the chains 41. Thus, the holdback tabs 56 in grouper conveyor $51_4$ separate each of the rows into subgroups of three articles deep.

Referring to FIG. 11, it will be seen that the three row grouper conveyor $51_3$ has two holdback tabs 56 thereon located on each flight bar 55 so that the two holdback tabs 56 project up through the spaces $S_N$ adjacent and on opposite sides of the center space $S_W$. Because the diameter of the articles in the three row grouping is so great, it is only necessary to engage one side of the articles to keep them in subgroups. It will be seen that the upper lane divider assembly $36_3$ laterally offsets the center row of articles so that one edge of the articles in the center row overhangs one of the spaces $S_N$. This allows opposite edges of one of the holdback tabs 56 to engage the articles in the center row of articles as well as one of the outboard rows of articles to perform the holdback function. Since the grouper conveyor $51_3$ is designed to subdivide each row of articles into subgroups two articles deep, it will be seen that the spacing between the flight bars is such that the holdback tabs 56 project up into every other space between the articles overhanging the conveyor chains 41 over the spaces $S_N$.

To affect the changeover between articles of different diameters and/or different load configurations, the upper lane divider assembly 36 is removed from the uprights 45 and the chains 52 on the grouper conveyor 51 removed from the sprockets. The grouper conveyor 51 for the desired size and/or load configuration is then selected and installed on the sprockets and the upper lane divider assembly 36 to form the desired number of rows of that particular size article are selected and installed on the uprights 45. Thus, it will be seen that no lateral spacing between the lane conveyor chains 41 need be made to affect change overs for different load configurations and/or different size articles.

It will be appreciated that the lane conveyor 40 also conveys the rows of articles into the loading section 22. Thus, the lane conveyor chains 41 extend into the loader section 22 to a dead plate 60. Since the chains 41 are moving faster than the grouper conveyor 51, it will be seen that, as each subgroup of articles in each row is released by the grouper conveyor 51, the subgroup will be moved away from the articles in the row still being held back by the grouper conveyor 51 so as to form a space between subgroups of articles in each row with the subgroups of articles in the different rows for each load being transversely aligned.

To keep the articles on the lane conveyor chains 41 after they pass out of the downstream end of the lane divider assemblies 36 and into the loading section 22, a lower lane divider arrangement 61 is provided. While the upper lane divider assembly 36 guided the upper ends of the articles, the lower lane divider arrangement 61 guides the lower ends of the articles in each row. There are a plurality of the lower lane divider arrangements 61 corresponding in number and dividing capability to the upper lane divider assemblies 36. Three different arrangements are illustrated in the drawings, matching the assemblies $36_6$, $36_4$ and $36_3$ with divider arrangement $61_6$ for the six row load, divider arrangement $61_4$ for the four row load, and divider arrangement $61_3$ for the three row load.

Each of the lower lane dividing units 61 includes a pair of lower side guides 62 which are positioned on opposite sides of the lane conveyor 40 with a plurality of lower lane dividers 64 that subdivide the space between the side guides 62 into the appropriate number of rows. The side guides 62 and lane dividers 64 are supported on the transverse support rods 65 which extend across the machine under the chain tracks 66 supporting the upper flights of the lane conveyor chains 41. It will be seen in FIGS. 6 and 8 that one of the support rods 65 is located just downstream of the discharge end of the grouper conveyor 51 while another support rod 65 is located adjacent the downstream end of the upper flights of conveyor chains 41.

Each of the lower side guides 62 includes a base member 68 sized to be removably supported on the support rods 65 outboard of the chain track 66 on the outboard chain 41. The thickness of the base member 68 is such that the base member 68 does not protrude above the surface of the lane conveyor chains 41 and its length is such that it will just fit in the space between the grouper conveyor 51 and the transfer plates 57 at the upstream end of dead plate 60. The base member 68 mounts an upstanding guide plate 69 thereon which projects a prescribed distance above the surface of the chains 41 so as to confine the articles passing along the upper flight of the outboard chain 41. The guide plate 69 has a cutout in its upstream end to fit under the downstream end of the side guide 46 on the upper land divider assembly 36 and affect smooth transfer between guides 46 and 62. The guide plate 69 is longer than the base member 68 so that, when the base member 68 is in position between the conveyor 51 and dead plate 60, the guide plate 69 extends from the discharge end of the conveyor 51 along the lane conveyor 40 and out over the dead plate 60. Each guide plate 69 has an upstream section 70 that extends along the conveyor 51 coëxtensive with the side guide 46 in the upper lane divider assembly 36, a transition section 71 at the downstream end of the section 70 over the dead plate 60 that angles inwardly toward the longitudinal centerline of the machine, and a discharge section 72 at the downstream end of the section 70 over the dead plate 60 which is parallel to the upstream section 70 but shifted inwardly thereof. The section 71 shifts the subgroups of articles in the outboard rows inwardly to form the final load as will become more apparent.

Each of the lower lane dividers 64 includes an elongate base member 75 sized to fit in the space $S_W$ or one of the spaces $S_N$ between the chain tracks 66. The length of the base members 75 is such that each will just fit in the space between the grouper conveyor 51 and the transfer plates 57 at the upstream end of dead plate 60. Mounted on each of the base members 75 and extending upwardly therefrom is one or more divider plates 76. The divider plates 76 correspond in transverse width to the line divider plate units 49 with which the upstream end is aligned as will become more apparent. The divider plates 76, like the guide plates 69, have a prescribed height which is just high enough to positively confine the lower ends of the articles therebetween. The divider plates 76 are longer than base members 75 so that the plates 76 will project out over the dead plate 60 in lateral registration with the transition sections 71 in guide plates 69. Some of the divider plates 76 also have transition sections 78 therein laterally aligned with the transition sections 71 in plates 69 to shift the subgroups of articles in the different rows toward the center of the machine so that when the subgroups pass out of the downstream end of the transition sections 71 and 78, all of the subgroups in the various rows will be arranged in a side-by-side relationship to form the load of articles to be loaded into the tray. It will be appreciated that while the lower side guides 62 and lower lane dividers 64 are separate pieces, the chain tracks 66 and the support rod 65 positively yet removably confine the side guides 62 and lane dividers 64 so that they are fixed longitudinally of and transversely of the product path.

Figures 7, 14:
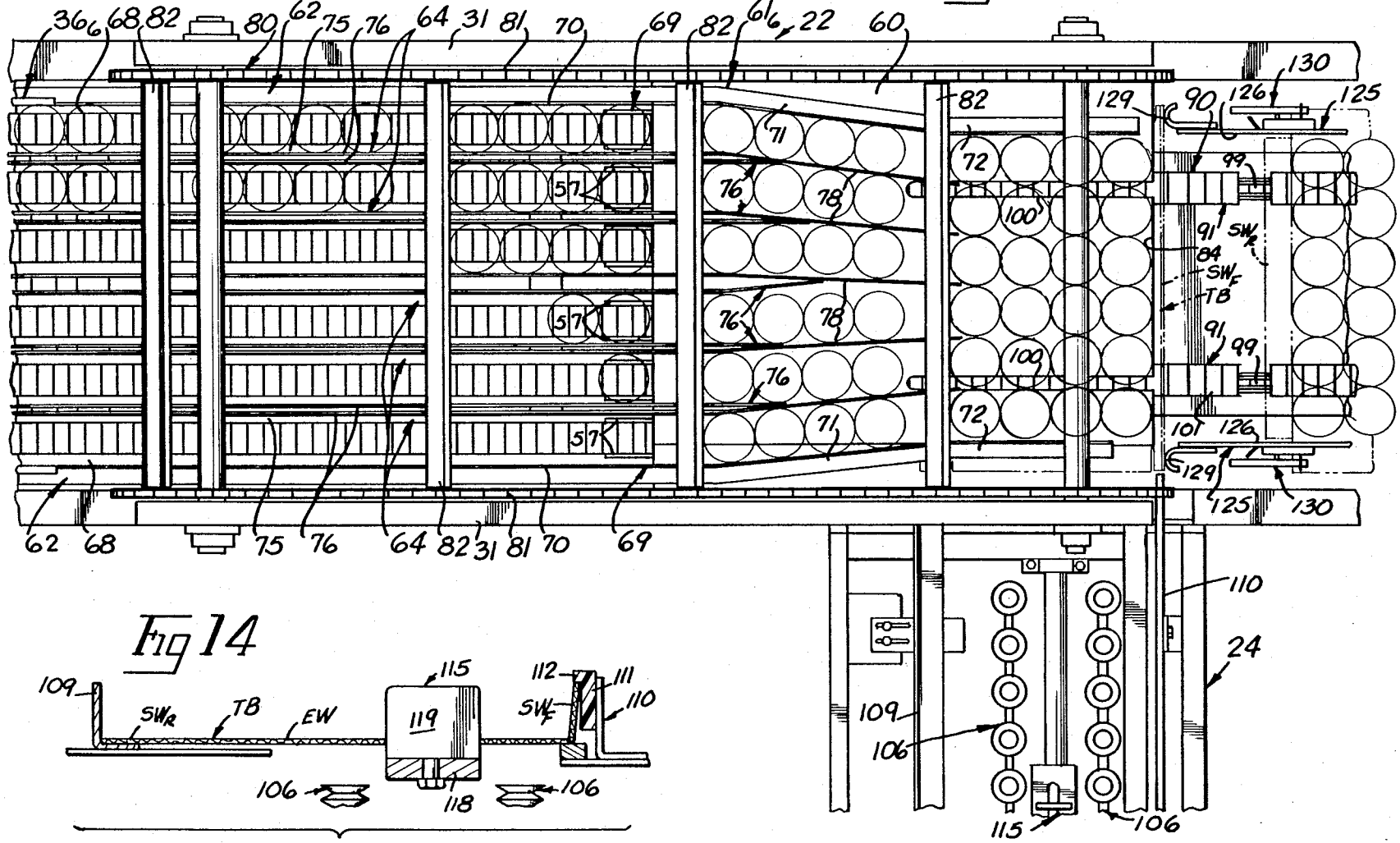
FIG. 7 is a top plan view of the loader section.
FIG. 14 is a partial transverse cross-sectional view of the blank feeder section.
Figure 8:
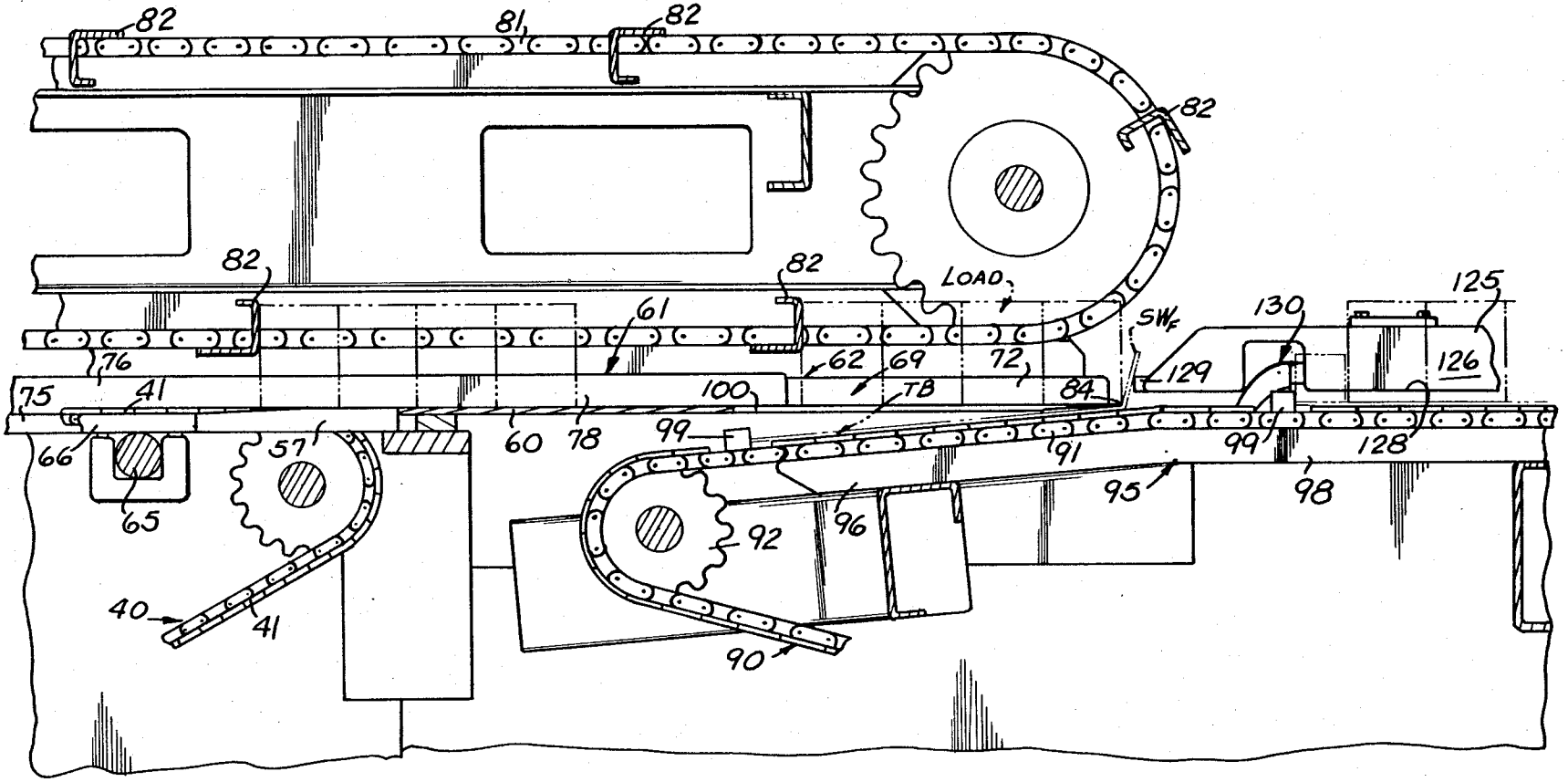
FIG. 8 is an enlarged longitudinal cross-sectional view of the loader section.
Figure 4:
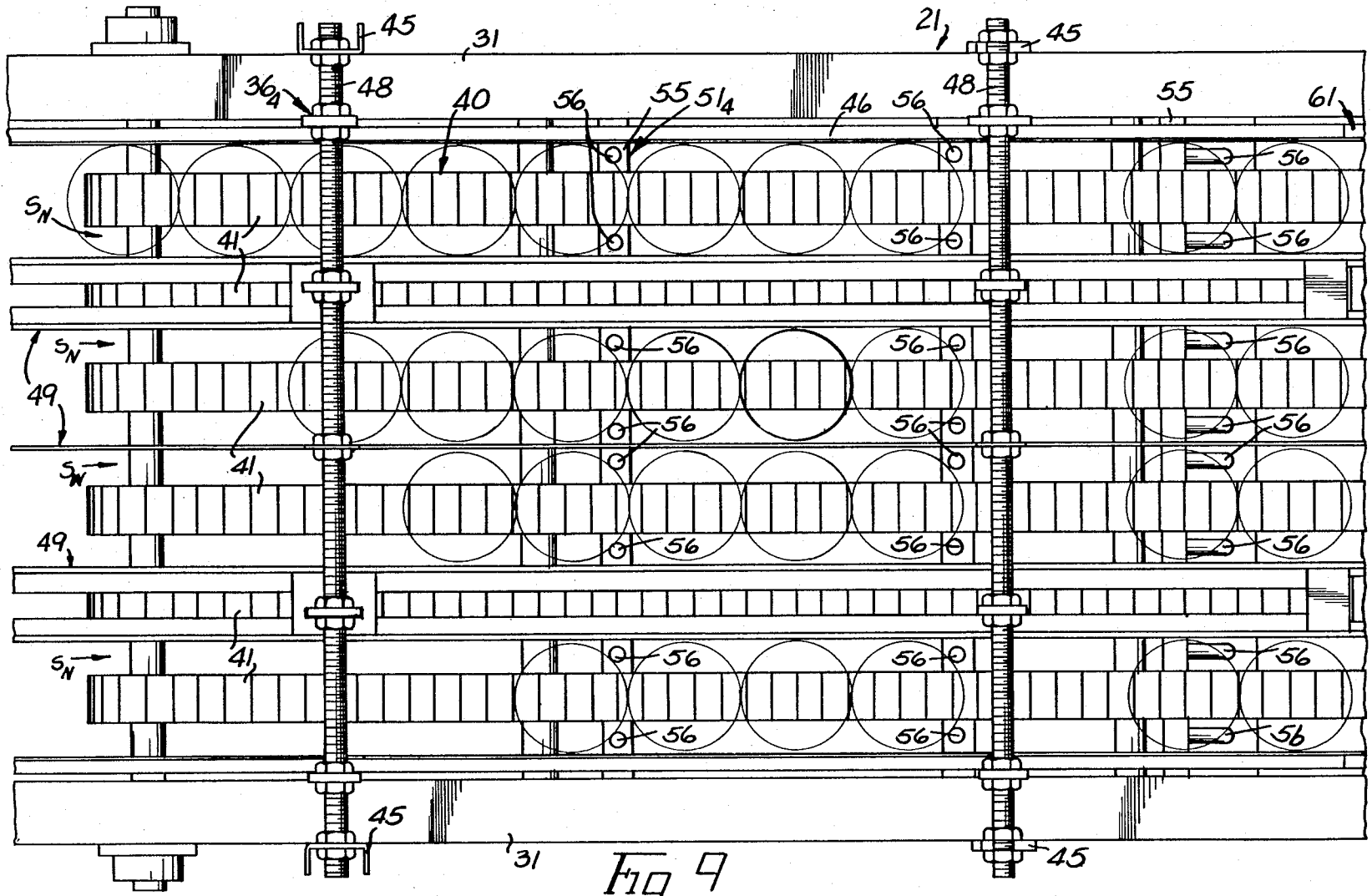

FIGS. 7 and 8 illustrate the lower lane divider arrangement $61_6$ for the six row load. Thus, there are five lane dividers 64. The base member 75 of the center lane divider 64 has a transverse width equal to the distance $d_1$ so that it will just fit in the center space $S_W$. The base members 75 of the other lane dividers 64 have a transverse width equal to distance $d_2$ so that they will fit in spaces $S_N$. Each of the lane dividers 64 has a pair of upstanding divider plates 76 to keep the rows of articles centered on chains 41. The transition sections 78 in the divider plates 76 shift the subgroups of articles inwardly over the dead plate 60 to close up the space between the rows to form the load.

Figure 10:
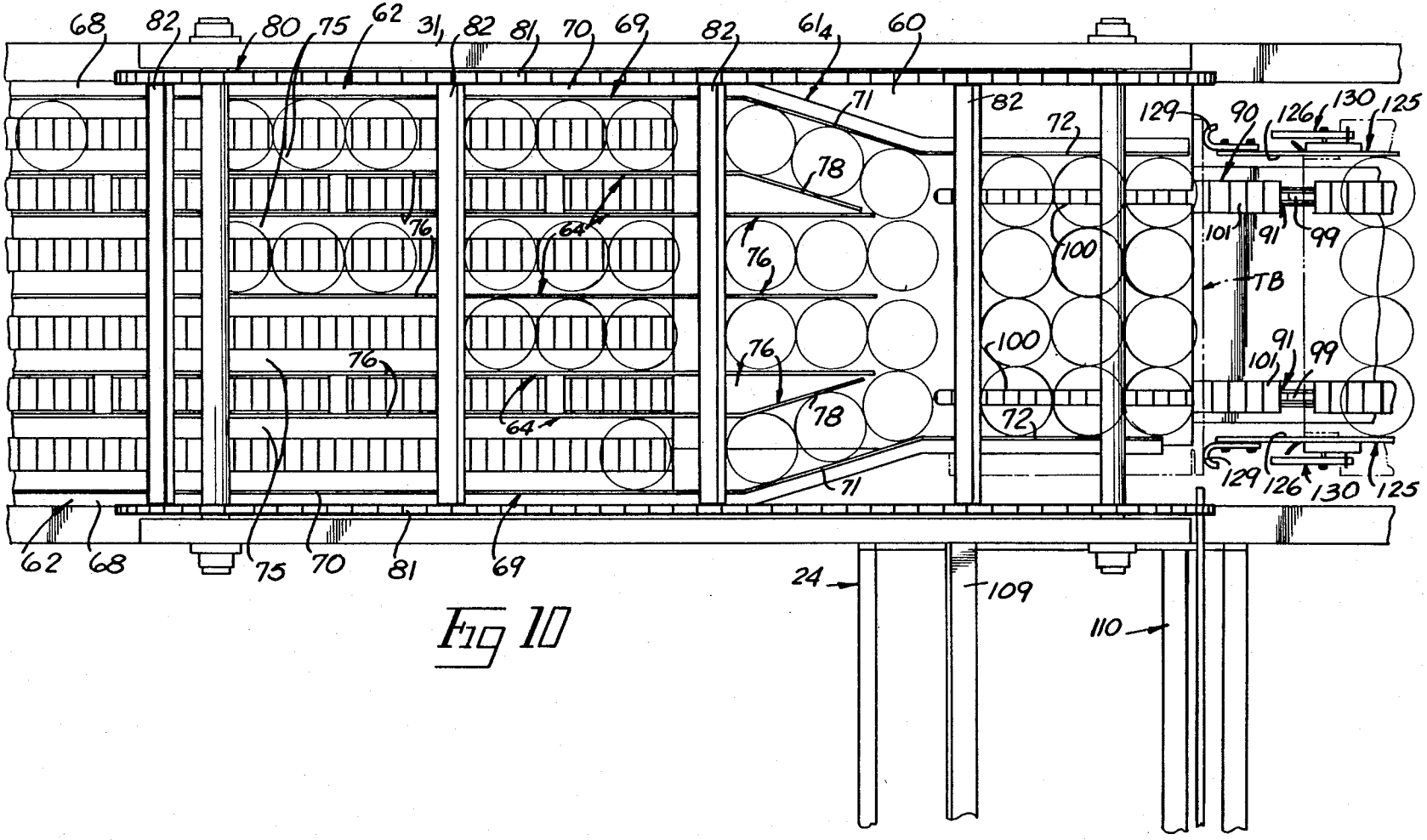
FIG. 10 is a top plan view of the loader section illustrating the grouping arrangement of FIG. 9.

FIG. 10 illustrates the lower lane divider arrangement $61_4$ for the four row load. There are also five lane dividers 64 used in this arrangement; however, the two outermost lane dividers 64 are connected to the two lane dividers 64 immediately inboard thereof so that there are effectively three units. The center lane divider 64 has a single upstanding divider plate 76 on the base member 75 sized to be mounted in space $S_W$. The two base members 75 in each of the interconnected divider units is sized to fit in the spaces $S_N$. The three central divider plates 76 extend straight over the dead plate 60 while the two outside divider plates 76 have transition sections 78. Thus, the two outside rows of articles are shifted inwardly to close up the spaces between the rows and form the load.

Figure 12:
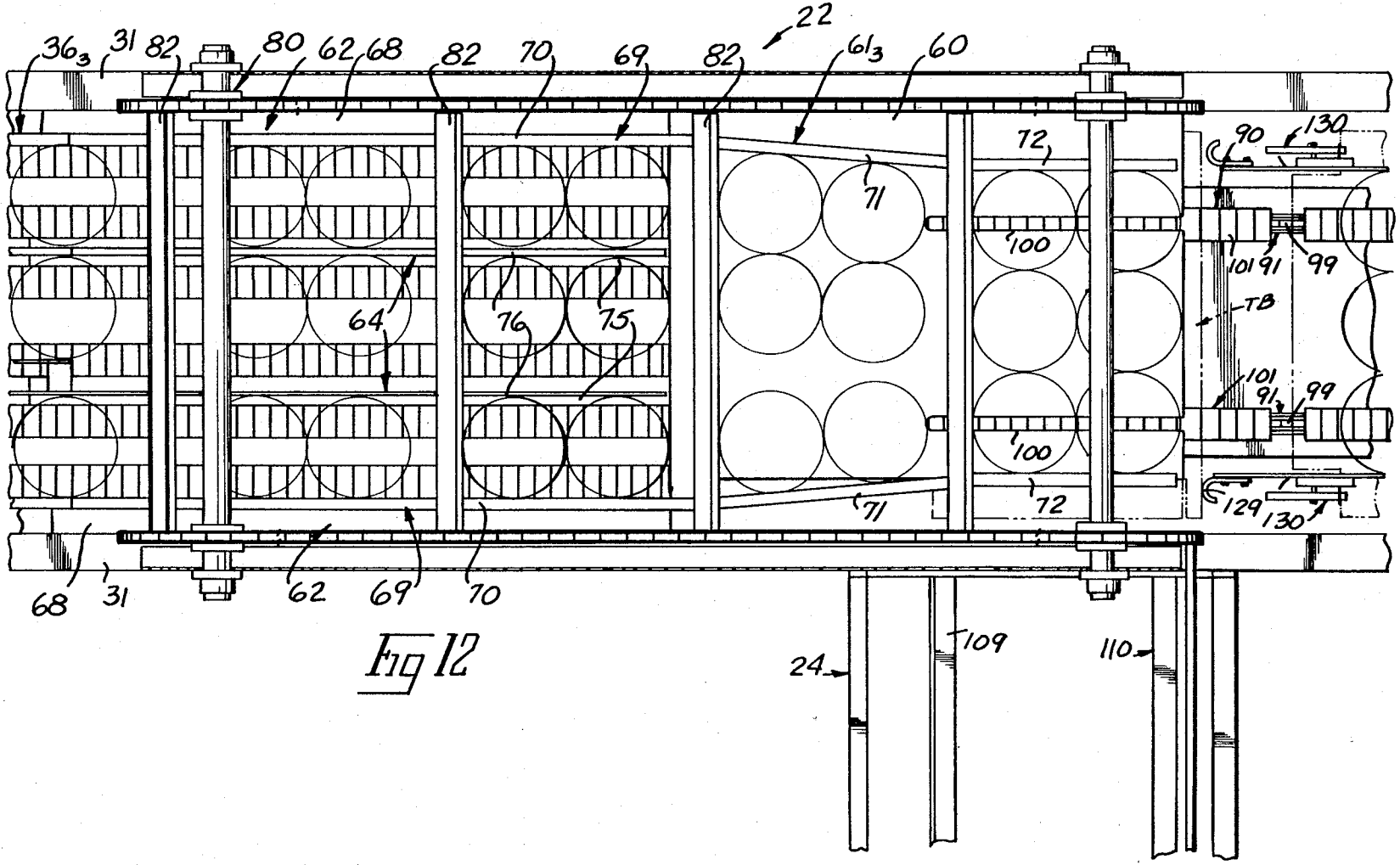
FIG. 12 is a top plan view of the loader section illustrating the grouping arrangement of FIG. 11.

FIG. 12 illustrates the lower lane divider arrangement $61_3$ for one of the three row loads. There are two lane dividers 64 mounted in the spaces $S_N$ adjacent the central space $S_W$. Thus, each of the base members 75 has a width equal to distance $d_2$. Each divider 64 has a single upstanding divider plate 76 with one of the divider plates equipped with a lip to keep the center row offset until it reaches the dead plate 60 where the transition sections 71 in the side guide plates 69 push the subgroups together to form the load.

To move the subgroups of articles in the rows across the dead plate 60 and to load the group of articles onto the tray, a top conveyor 80 is provided as best seen in FIGS. 7 and 8. The top conveyor 80 is located above the lower lane divider arrangement 61 over the lane conveyor chains 41 extending into the loading section 22. The top conveyor 80 includes a pair of spaced apart flight chains 81 mounted above and on opposite sides of the lower lane divider arrangement 61 with each of the flight chains 81 carried by spaced apart sprockets mounted on shafts common with the sprockets carrying the other flight chain 81. A plurality of flight bars 82 are connected between the flight chains 81 so that the flight bars 82 are located transversely of the lane conveyor chains 41 with the lower flights of chains 81 being located so that the flight bars 82 pass just above the lower side guides 62 and lower lane dividers 64 as they move along the lower flights of the chains 81. The chains 81 are arranged so that the flight bars 82 move down between the subgroups in the rows just downstream of the grouper conveyor 51. The lower flights of chains 81 have lengths such that the flight bars 82 move across the dead plate 60. Thus, each flight bar 82 engages the laterally aligned subgroups in all of the rows to be collected into a single load and pushes the thusly collected load off of the downstream edge of the dead plate 60 onto the tray blank as will become more apparent. The spacing between the flight bars 82 is such that the top conveyor 80 does not have to be changed as the different loads are packaged.

For each different load configuration and for each different diameter of article within that load configuration, it will be appreciated that there will be an upper land divider assembly 31 matched with a grouper conveyor 51 and a lower lane divider arrangement 61. To do a changeover, the assembly 31 is removed and the side guides 62 and lane dividers 64 of the lower lane dividing arrangement 61 lifted out. The chains 52 in the grouper conveyor 51 are disconnected and removed. The matched set for the new configuration and/or diameter is selected and the process reversed to mount the selected conveyor 51, lower lane divider arrangement 61 and upper lane divider assembly 31. Because the changeover is simplified, the time and effort required to affect the changeover is greatly reduced.

Figure 2:
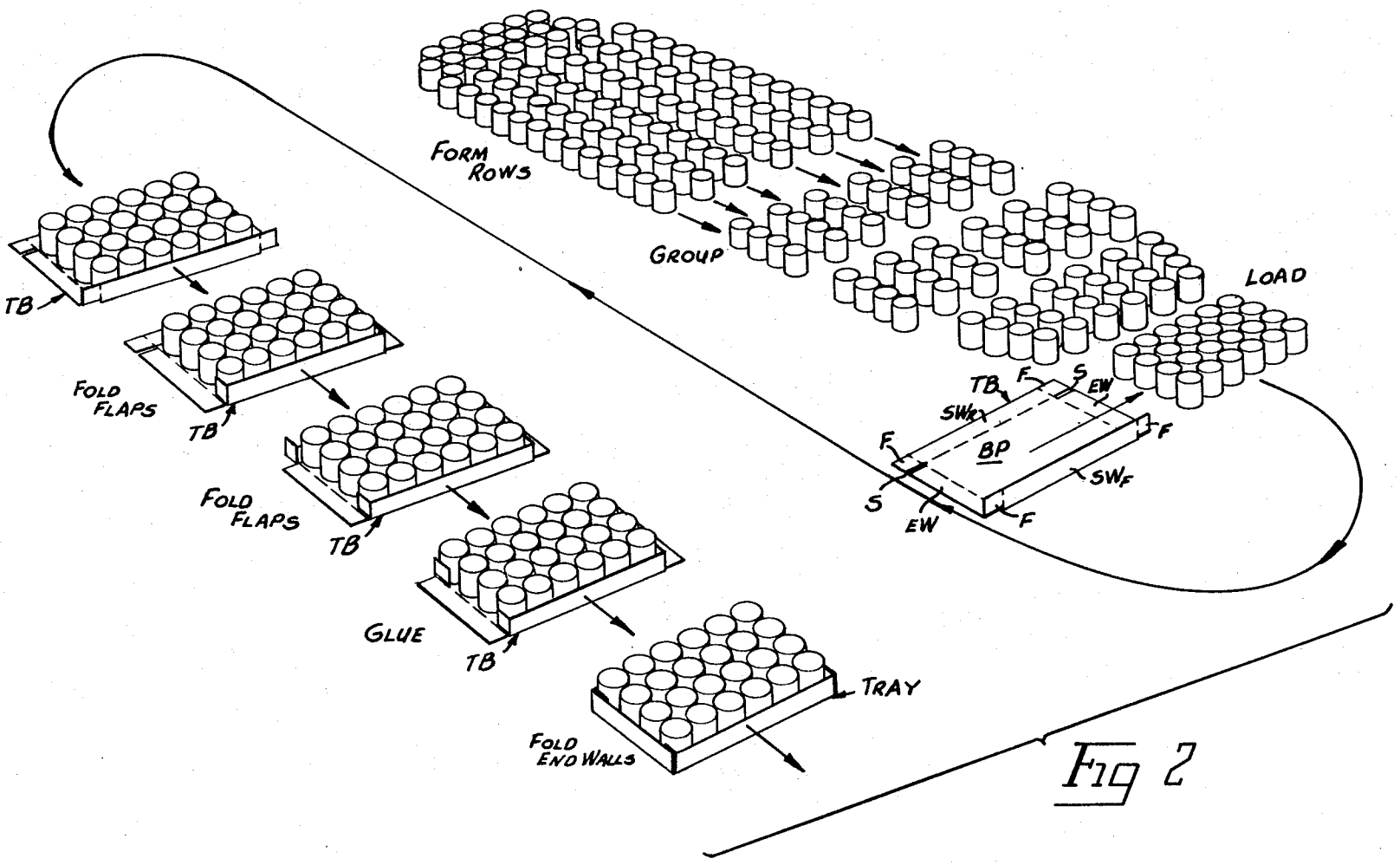
FIG. 2 is a perspective view illustrating the tray loading and erection steps.

As best seen in FIG. 2, the precut tray blanks TB from which the trays are erected are supplied to the machine in a flat condition with fold lines dividing the tray blank into a bottom panel BP, front and rear side walls $SW_F$ and $SW_R$ and end walls EW. The side walls SW are foldably joined to flaps F at opposite ends thereof. The flaps F are separated from the end walls EW by slots S. To erect the tray, the side walls SW are folded into upright positions, the flaps F folded into a square condition with the side walls SW, and finally the end walls EW folded up over the folded flaps F. Glue is applied between the end walls EW and flaps F to hold the tray in an erected condition.

Referring to FIGS. 7 and 8, a tray blank conveyor 90 is mounted in the loading section 22 with its upstream end located under the dead plate 60. The conveyor 90 extends out from under the downstream edge of dead plate 60 so that a tray blank loaded onto conveyor 90 under the dead plate 60 will be pushed out from under the dead plate 60 synchronously with the movement of the load of articles off of the downstream edge 84 of the dead plate 60. This permits the load of articles to be placed on the tray blank in registration with the bottom panel thereof.

The conveyor 90 includes a pair of spaced apart conveyor chains 91 extending longitudinally of the machine and trained around upstream and downstream sprockets 92 and 94. The upper flights of the chains 91 are positioned on chain tracks 95 with an angled section 96 at the upstream end thereof which angles down under the dead plate 60 while the downstream section 98 thereof is generally coplanar with plate 60. Thus, it will be seen that the upstream portions of the upper flights of chains 91 angle down under the dead plate 60 and are spaced below the downstream edge 84 of dead plate 60 just enough for the tray blank TB to be slidably received on the chains 91 under the dead plate 60. As will become more apparent, the feeder section 24 moves the tray blank TB into position along a loading path transversely of the main processing path extending longitudinally through the machine.

Each of the chains 91 mounts drive lugs 99 thereon at spaced apart positions so that the tray blanks TB will fit between lugs 99 when the tray blank is flat. The upper flights of the chains 91 move in the downstream direction along the processing path to engage the trailing edge of the tray blank TB (i.e., the projecting edge of the rear side wall $SW_F$ since the rear side wall is still in an unfolded condition coplanar with the bottom panel of the tray). The dead plate 60 is provided with slots 100 through which the lugs 99 pass as they push the tray blank out from under the dead plate 60. The drive lugs 99 on chains 91 are moved synchronously with the flight bars 82 on the top conveyor 80 so that the load of articles is deposited on top of the tray blank TB in registration with the bottom panel BP thereon. Thus, as soon as the load of articles is deposited on the tray blank, the load of articles is supported on and moves with the tray blank. To support the tray blank, especially after it is loaded, the chains 91 are provided with cross plates 101 between the lugs 99.

Figure 13:
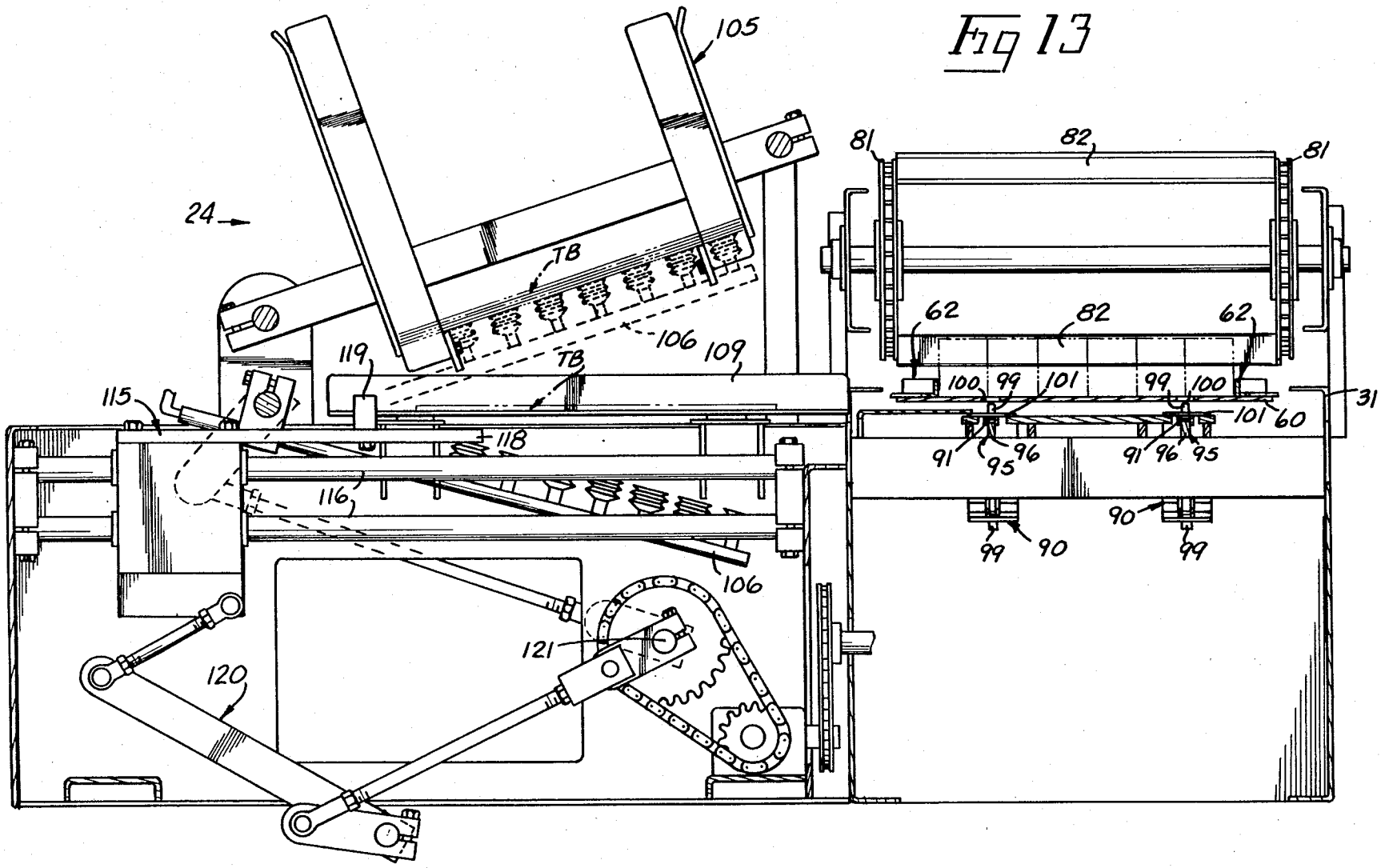
FIG. 13 is a longitudinal cross-sectional view of the blank feeder section.
Figure 15:
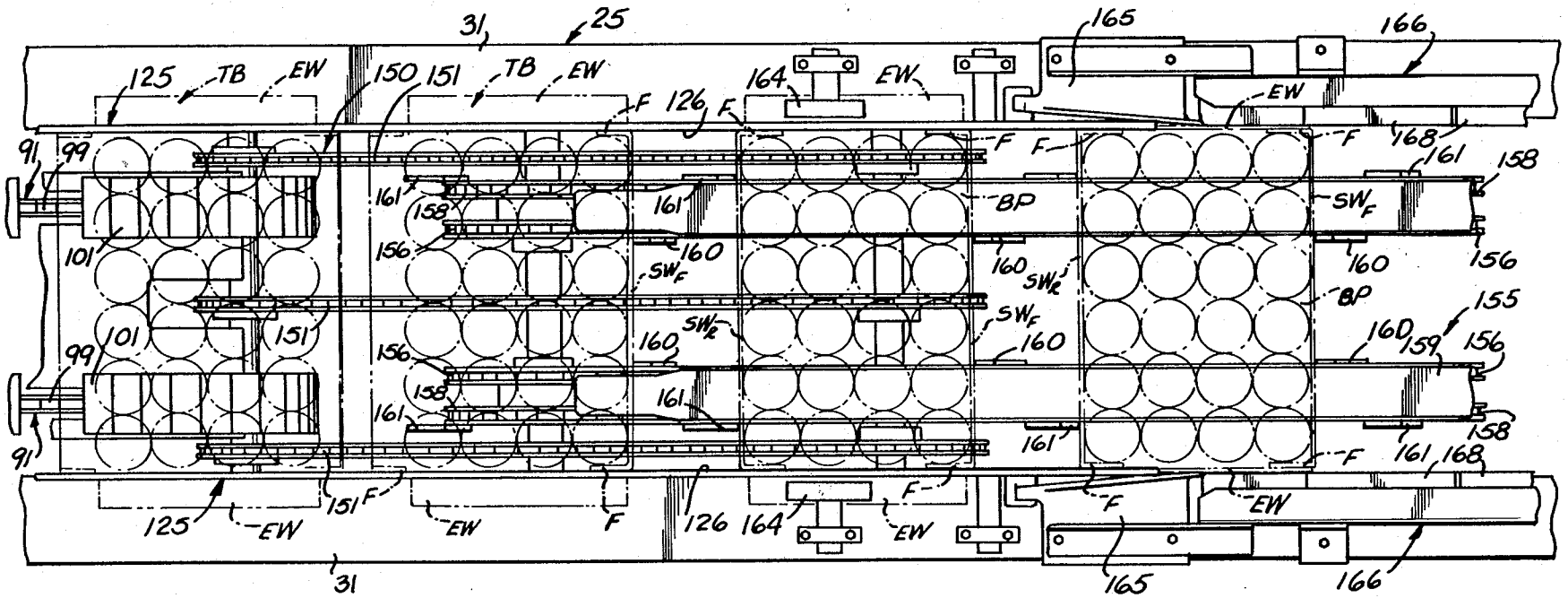
FIG. 15 is a top plan view of the erection section.
Figure 16:
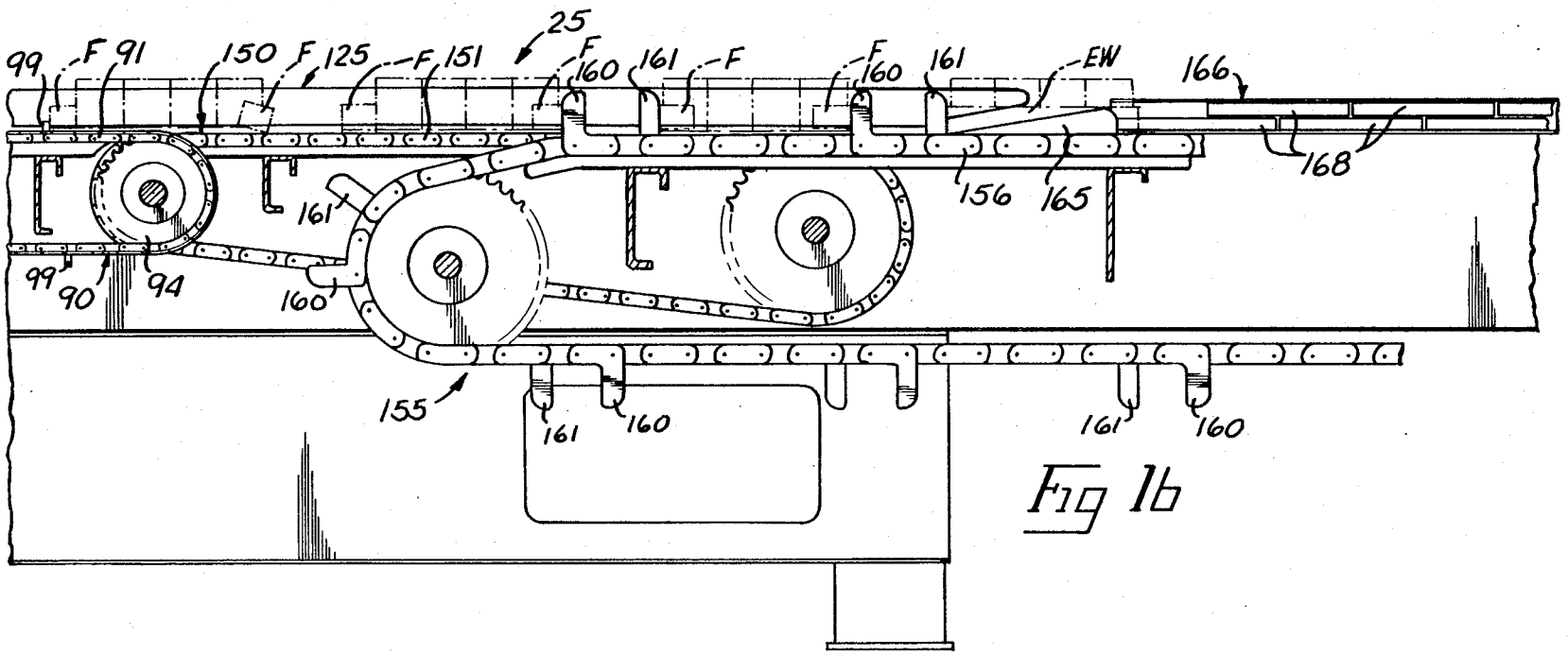
FIG. 16 is a longitudinal cross-sectional view of the erection section.

The blank feeder section 24 best seen in FIGS. 13 and 14 includes a magazine 105 which supports a stack of tray blanks in a flat condition so that the tray blanks can be withdrawn from the bottom of the stack one at a time by an oscillating vacuum cup assembly 106. The vacuum cup assembly 106 is pivoted up and down by an appropriate drive linkage 108 and vacuum is selectively drawn through the vacuum cup assembly from a conventional source (not shown) so that when the assembly 106 is pivoted up, the vacuum sucks the lowermost tray blank onto the assembly 106 and the tray blank is pulled downwardly therewith onto a pair of spaced apart blank guides 109 and 110 whereupon the vacuum is removed to release the tray blank onto the guides 109 and 110. It will be appreciated that the guides 109 and 110 hold the tray blank at the same angle as the upstream portions of the conveyor chains 91 to facilitate the loading of the tray blank onto the chains 91. The guide 110 on the leading side of the tray blank is located with respect to the vacuum cup assembly 106 so that the front side wall $SW_F$ on the tray blank TB will be folded up about the fold line between it and the bottom panel BP. The guide 110 has a vertical leg 111 provided with an inwardly turned lip 112 spaced so that the projecting edge of the front side wall $SW_F$ will just fit thereunder when the side wall $SW_F$ is folded to its upstanding position as seen in FIG. 14. This serves a reinforcing function to insure that the bottom panel BP will remain flat as the tray blank is pushed under the dead plate 60. This feature also serves to keep the bottom panel BP down against guide 110 as it is pushed into position under the dead plate 60. The corner between the upstanding front side wall $SW_F$ and the bottom panel BP also serves as a guide to direct the tray blank so that the side wall $SW_F$ passes just forwardly of the discharge edge 84 of the dead plate 60.

To push the tray blank TB from its pulled down position in the feeder section 24 onto the conveyor 90 under the dead plate 60, a pusher 115 is provided which is reciprocally mounted on a pair of support rods 116 extending transversely of the product path through the machine. The pusher 115 has a horizontally extending support plate 118 lying just below the plane of the tray blank when it is supported on guides 109 and 110. The support plate 118 mounts an upstanding pusher block 119 thereon which projects above the plane of the tray blank carried between guides 109 and 110. The block 119 can be adjusted along the length of plate 118 to handle different size tray blanks. A compound drive linkage 120 connects the pusher 115 to the same drive shaft 121 driving the vacuum cup assembly 106 so that the pusher 115 is reciprocated back and forth along the support rods 116 synchronously with the movement of the vacuum cup assembly 106. Thus, as the pusher 115 is reciprocally moved away from the conveyor 90 in the loading section 22, the vacuum cup assembly 106 lowers another tray blank onto the guides 109 and 110 while clearing the pusher block 119. As the pusher 115 is reciprocally moved back toward the conveyor 90, the pusher block 119 engages the projecting edge of the outboard end wall EW on tray blank TB and pushes the tray blank into position under the dead plate 60 and over the chains 91. The block 119 and the linkage 120 is adjusted so that the bottom panel of the tray blank TB is transversely centered under the load of articles on the dead plate 60. The movement of the tray blank onto conveyor 90 is timed so that the tray blank passes between two sets of drive lugs 99 on chains 91 so that the lugs 99 will engage the projecting edge of the rear side wall on the tray blank to push the tray blank out from under the dead plate 60 synchronously with the movement of the article load over the dead plate.

It will be appreciated that the weight of the article load on top of the tray blank holds it down on top of the conveyor 90 after the tray blank moves out from under the dead plate. This allows the drive lugs 99 to continue to drive the loaded tray blank along the processing path.

Located immediately downstream of the upturned front side wall $SW_F$ of the tray blank TB when it is pushed into registration with the article load under the dead plate 60 are a pair of upstanding end guides 125 as best seen in FIGS. 7 and 8. The upstanding inside guide surfaces 126 on the guides 125 are in registration with opposite ends of the article load so that the article load will be confined therebetween as they are moved by the conveyor 90. As best seen in FIG. 8, the bottom edges 128 of the guides 125 are spaced above the plane of the bottom panel of the tray blank so that the end walls thereon will pass under the guides 125.

Figure 17:
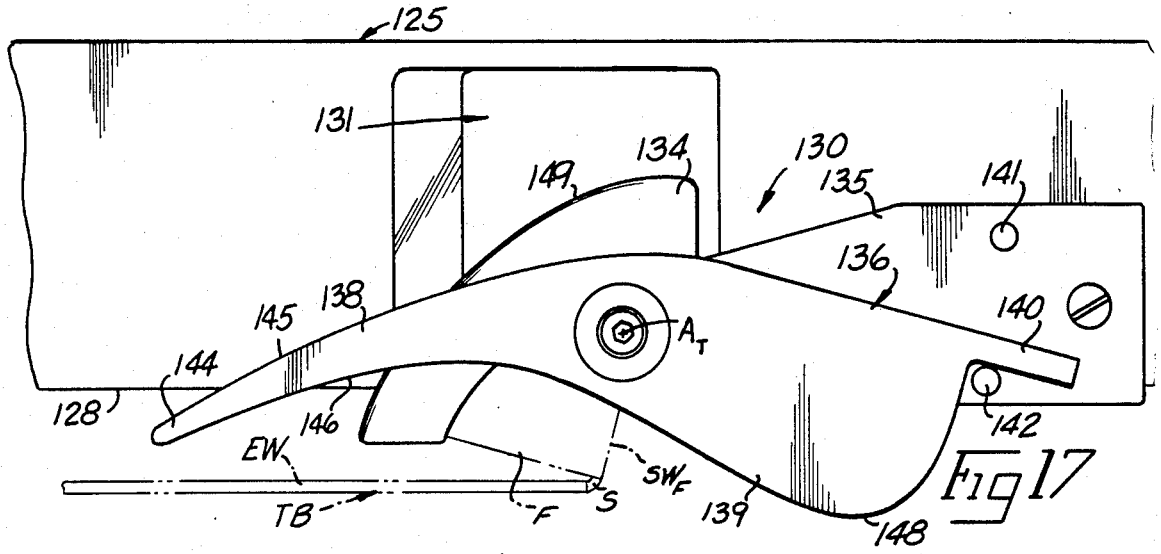
FIG. 17 is an elevational view of the trailing flap folder in its initial position.
Figure 18:
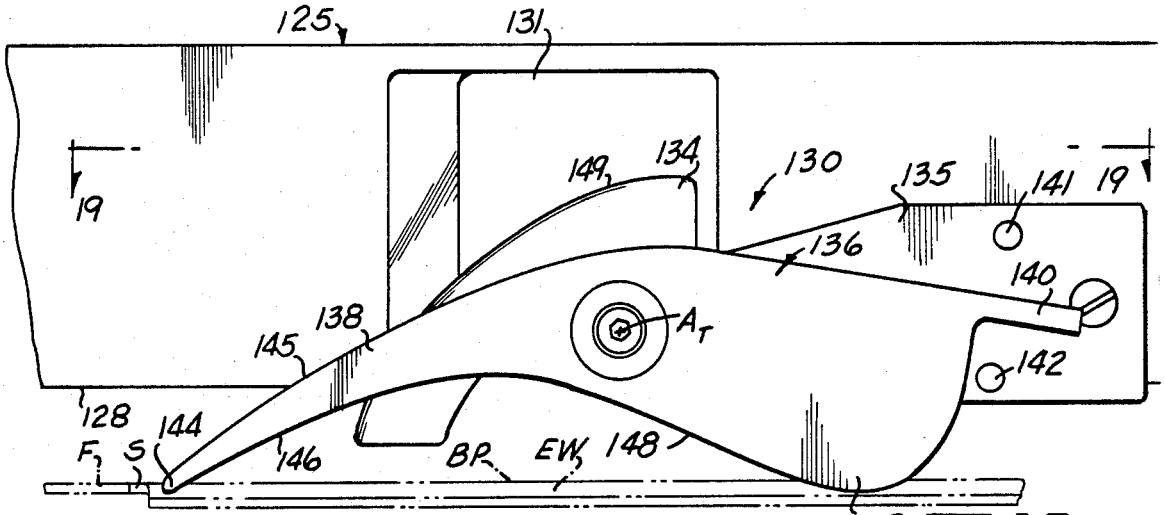
FIG. 18 is a view similar to FIG. 17 showing the flap folder in its transferred position.
Figure 19:
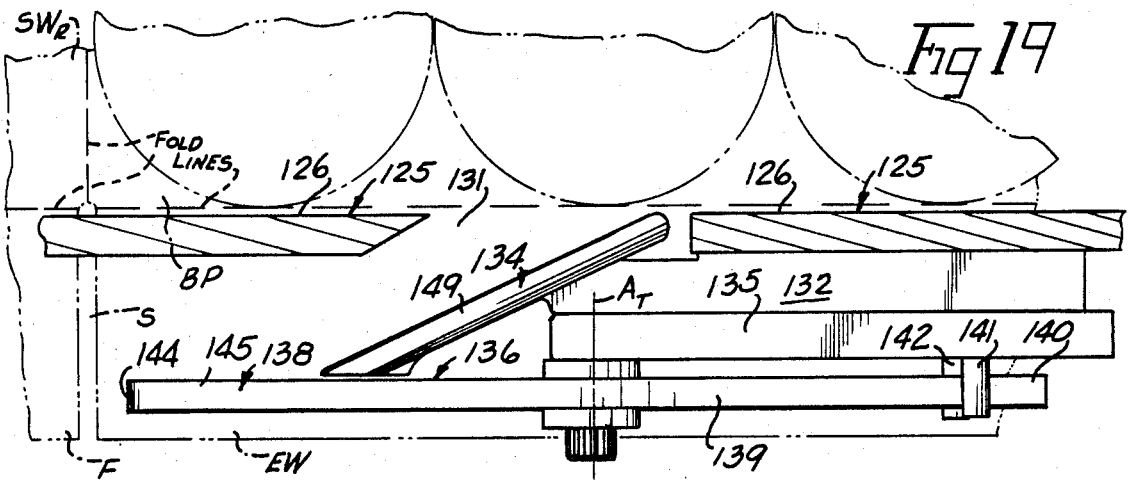
FIG. 19 is a view taken along line 19—19 in FIG. 18.

The leading end of each of the guides 125 is provided with an outwardly curved leading flap folder 129. The flap folders 129 are positioned close enough to the downstream edge of the dead plate 60 to hold the front wall $SW_F$ on the tray blank under the dead plate in an upstanding position. As the tray blank and article load are synchronously moved by the blank conveyor 90 and top conveyor 80, the flaps on opposite ends of the upstanding front side wall $SW_F$ to engage the flap folders 129. This pivots the front side wall $SW_F$ rearwardly along with the flaps until the front side wall engages the leading edge of the article load. This arrests the pivoting of side wall $SW_F$ and causes the flaps to be folded inwardly into a square condition with respect to the front side wall $SW_F$ and to pass along the inside guide surfaces 126 on the end guides To fold the flaps on the rear side wall of the tray blank into a squared position with the rear side wall, a pair of trailing flap folder assemblies 130 are provided with one being mounted on each of the end guides 125 downstream of the leading flap folders 129. As best seen in FIGS. 17–19, each of the trailing flap folding assemblies 130 is mounted on the outside of the end guide 125 in registration with a flap opening 131 in the end guide 125 so that the flap on the trailing side wall which projects under the guide 125 can be folded up through the opening 131 to ride along the inside surface 126 of the guide 125 in a square condition with respect to the trailing side wall $SW_F$.

The flap folding assembly 130 includes a base plate 132 which mounts a deflector member 134 on the upstream end thereof in registration with the flap opening 131. A pivot base 135 is mounted on the outside of the base plate 132 and pivotally mounts thereon a trip member 136 about a pivot axis $A_T$ normal to the direction of movement of the tray blank along the processing path. The trip member 136 is located so that it pivots in a plane outboard of the deflector member 134 but which intersects the unfolded flaps on the rear side wall $SW_R$ and the end wall EW. The trip member 136 includes a finger portion 138 which extends in the upstream direction and camming portion 139 which extends in the downstream direction from the pivot axis. The center of mass of the trip member 136 is located downstream of the pivot axis $A_T$ so that the trip member 136 is urged in the clockwise direction as seen in FIGS. 17 and 18 by its own weight. The downstream end of the camming portion 139 is provided with stop projection 140 which cooperates with upper and lower stops 141 and 142 to limit the pivoting of the trip member 136 about the axis $A_T$.

The finger portion 138 of the trip member 136 curves downwardly to a thin tip 144 sized to pass through the slot S between the end wall EW and flap F on the trailing side wall $SW_R$ as will become more apparent. The top of the finger portion 138 is provided with an upwardly curved upper deflecting surface 145 while the bottom of the finger portion 138 is provided with an upwardly curved lower deflection surface 146. The bottom of the camming portion 139 is provided with a downwardly curved cam surface 148. The relationship between the tip 144 and cam surface 148 is such that, when the stop projection 140 is resting on the lower stop 142 as seen in FIG. 17, the cam surface 148 extends below the plane of the bottom panel in the tray blank being moved by the blank conveyor 90 while the tip 144 will be spaced above the plane of the bottom panel in the tray blank being moved by the conveyor 90. Thus, it will be seen that the leading end of the end wall EW will pass under the tip 144 as seen in FIG. 17. The leading end of the end wall EW will, however, engage the cam surface 148 on the trip member 136 and pivot the trip member 136 in a counterclockwise direction as seen in FIGS. 17 and 18 until the tip 144 engages the end wall EW when the tip 144 and the lowest point on the cam surface 148 lie in a common horizontal plane. Preferably, the trip member 136 is located so that the end wall EW is deflected slightly downwardly as seen in FIG. 18 when the cam surface 148 and tip 144 are both riding along the end wall EW. The tip 144 and cam surface 148 ride along the end wall EW until the tip 144 drops into slot S between the trailing end of the end wall EW and the leading edge of the flap F on the end of the trailing side wall $SW_R$. This allows the tip 144 to pass through the slot S so that the flap F will pass along the top of the finger portion 138 over the upper deflection surface 145. The trip member 136 may pivot further in a counterclockwise direction and its movement is arrested by the stop projection 140 thereon engaging the upper stop 141. This causes the flap to be forced up over the upper deflecting surface 145 to start pivoting the flap inwardly about the fold line between the flap and the trailing side wall $SW_R$.

The deflector member 134 projects upstream from the base plate 132 and curves downwardly therefrom so that the upstream projecting end of the deflector member 134 is located just inboard of the trip member 136 and lies in a plane above the plane of the bottom panel BP of the tray blank so that the end wall EW will pass thereunder as seen in FIG. 17. The deflector member 134 has an upwardly curved upper deflection surface 149 which extends from its lower projecting end above the upper deflecting surface 145 on the trip member 136 and also extends at an angle with respect to the trip member 136 and the end guide 125 so that the deflection surface 149 projects through the flap opening 131 in the end guide 125 to the plane of the inside surface 126 on the guide 125. Thus, it will be seen that the upper deflection surface 149 on the deflector member 134 continues to pivot the flap inwardly over the trailing side wall $SW_R$ so that the flap F passes through the flap opening 131 as it is folded to its final square condition with respect to the trailing side wall $SW_R$ and then passes along the inside surface 126 on the end guide 125. It will be seen that each of the trailing flap folding assemblies 130 is able to skip the folding of the end wall EW while folding the flap on the trailing side wall $SW_R$ immediately trailing it. The flaps on both the leading and trailing side walls SW are now folded into a square position with respect to the side walls and held in that position by the end guides 125 as the conveyor 90 continues to move same.

The blank conveyor 90 discharges the loaded tray blank with the flaps folded onto a transfer conveyor 150 which moves the loaded tray blank into the erection section 25 to complete the erection of the tray blank around the load of articles. The transfer conveyor 150 includes three spaced apart conveyor chains 151 whose upper flights are coplanar with the upper flights of the chains 91 on the blank conveyor 90 and serve to shift the loaded tray blank to an erection conveyor 155 which transfers the loaded tray through the erection section 25 while the erection of the tray is completed.

The erection conveyor 155 includes a pair of spaced apart leading conveyor chains 156 and a pair of spaced apart trailing conveyor chains 158 with opposite ends of the chains 156 and 158 trained on sprockets mounted on common shafts. The chains 156 and 158 are arranged in pairs under a pair of spaced apart slide plates 159 so that the loaded tray blank is transferred from the transfer conveyor 150 onto the slide plates 159 to be moved therealong by the erection conveyor 155.

The leading conveyor chains 156 mount laterally aligned holdback lugs 160 thereon at spaced apart positions along the length thereof so that the holdback lugs 160 on chains 156 pass just inboard of the slide plates 159 and project above the tops of the plates 159 to engage the leading side wall $SW_F$ on the tray blank. The trailing or upstream facing edge of the holdback lugs 160 engage the leading side wall $SW_F$ and is curved at the upper end thereof so as to deflect the side wall $SW_F$ into an upright position as the holdback lug 160 engages the side wall $SW_F$. It will be appreciated that the transfer conveyor 150 is running at a faster speed than the erection conveyor 155 so that the transfer conveyor 150 drives the loaded tray blank against the holdback lugs 160.

The trailing conveyor chains 158 mount laterally aligned drive lugs 161 thereon at spaced apart positions located so that the drive lugs 161 pass just outboard of the slide plates 159. The drive lugs 161 are positioned in matched pairs with each pair of holdback lugs 160 so that when the loaded tray is engaged by the holdback lugs 160, the drive lugs 161 will engage the trailing side wall $SW_R$ and fold the trailing side wall into an upright position. It will be appreciated that each of the conveyor chains 156 and 158 has a downwardly angled section at its upstream end so that the lugs 160 and 161 rise up above the bottom of the loaded tray to insure that the side walls SW are folded into position. The leading or downstream edge of the drive lugs 161 engages the rear side wall $SW_R$ of the tray and its upper end is rounded to facilitate the folding of the trailing side wall $SW_R$ from its flat to its erected position. The spacing between each matched pair of holdback lugs 160 and drive lugs 161 is such that the side walls SW will be maintained in an erected position against the leading and trailing edges of the article load with the flaps on each of the side walls being held in a squared position by the end guides 125.

It will be appreciated at this point that the end walls EW project out from under the end guides 125. As the erection conveyor 155 moves the partly erected loaded tray blank along the processing path, the end walls EW pass under a pair of spaced apart glue applicators 164 which apply glue at appropriate locations on the end walls EW to register with the folded flaps on the side walls when the end walls are folded up to the erected position. As the erection conveyor 155 continues to move the partly erected tray blank, the end walls EW are engaged by flap folders 165 positioned on opposite sides of the machine to fold the end walls EW to an upright position. It will be appreciated that the end guides 125 terminate above the flap folders 165 to keep the flaps folded until the flap folders 165 deflect the end walls EW into position to hold the flaps in an upright position and to cause the adhesive to bond the end walls to the flaps.

Compression assemblies 166 are located on the machine immediately downstream of the flap folders 165 to urge the end walls inwardly against the article load and keep the end walls erected until the adhesive has time to bond the end walls to the flaps and hold the tray in an erected position. The compression assemblies 166 include a plurality of spring loaded compression members 168 which engage the end walls EW as the end walls EW slide therealong while the tray is being carried by the erection conveyor 155. After the glue has set, the erected and loaded tray is discharged out of the erection section 25 to be processed through the film wrapper 12 and shrink tunnel 15.

FIG. 2 summarizes the operation of the tray former/-loader 11. First, the unordered incoming articles are arrnaged in rows. The rows are then divided into subgroups. The subgroups are combined into an article load. The tray blank TB is inserted laterally under the article load and then moved synchronously with the article load so that the load is deposited on the tray. The flaps on the front side wall are first folded to a square condition with respect to the front side wall. The rear flaps are then folded to a square condition with respect to the rear side wall. The front and rear side walls are folded up around the article load and the end walls have glue applied thereto. Finally, the end walls are folded up to attach the end walls to the flaps and complete the erection of the tray.

What is claimed as invention is:

1. A method of loading articles in trays comprising the steps of:

supporting a stack of pre-cut try blanks in a feeder station where each of the tray blanks has fold lines defining a bottom panel, front and rear walls with flaps, and a pair of end walls;

pulling one of the tray blanks from the bottom of the stack;

folding the front wall of the tray blank toward an upright position;

pushing the tray blank onto a tray conveyor in a loading station and under a dead plate with a downstream edge while maintaining the front wall of the tray blank in the folded position as the tray blank is pushed onto the tray conveyor to maintain the bottom panel in a flat condition;

releasing the front wall of the tray blank as the tray blank is positioned under the dead plate;

pushing the tray blank out from under the downstream edge of the dead plate while the bottom panel is supported on the tray conveyor;

pushing a load of articles over the dead plate and off of the downstream edge thereof synchronously with the movement of the tray blank out from under the dead plate so that the load of articles are deposited onto the tray blank in registration with the bottom panel;

as the load of articles is pushed off of the dead plate onto the tray blank, passing the tray blank between front flap folding means and folding the front flaps to a square position with respect to the front wall;

releasing the load of articles deposited on the tray blank so that the load of articles is supported on and conveyed with the tray blank;

after the load of articles are released and supported on the tray blank, passing the tray blank and articles between rear flap folding means positioned downstream of the front flap folding means and folding the rear flaps to a square position with respect to the rear wall; and while maintaining the front and rear flaps in the square position with respect to said front and rear walls respectively, transferring the loaded tray to erection means, and folding the front and rear walls to a square position with respect to the bottom panel and folding the end walls to a square position with respect to the bottom panel while adhesively bonding the end walls to the front and rear flaps to maintain the tray in an erected position.

2. A packaging machine for loading articles onto tray blanks with fold lines defining a bottom panel, front and rear walls with flaps, and a pair of end walls separated from the flaps by slots and coplanar with the flaps comprising:

a dead plate having a top surface and a downstream edge;

loading forming means for arranging a group of the articles to be loaded in the tray and for moving the group of articles in a prescribed horizontal direction across the top surface of said dead place and over the downstream edge thereon;

tray conveyor means extending under said dead plate for moving a flat tray blank along a prescribed horizontal path of movement out from under said dead plate and the downstream edge thereof in said prescribed direction and synchronously with the movement of the group of articles across said dead plate so that the group of articles is deposited on the tray blank in registration with the bottom panel;

front flap folding means for folding the flaps on the front wall of the tray blank to a square condition with respect to the front wall as the tray blank is moved thereby by said tray conveyor means;

rear flap folding means located downstream of said front flap folding means for folding the flaps on the rear wall to a square condition with respect to the rear wall as the tray blank is moved thereby by said tray conveyor means; and a pair of spaced apart end guides having upstream ends located downstream of said dead plate and oriented parallel to the path of movement of the loaded tray to confine the load of articles therebetween, said front flap folding means located at the upstream ends of said end guides for folding the front wall flaps to the square condition so that said front wall flaps pass between said end guides, said rear flap folding means located downstream of said front flap folding means, and said end guides defining openings therethrough in registration with said rear flap folding means so that the rear flaps pass through said openings as said rear flaps are folded to the square condition to lie between said end guides means for folding the front and rear walls against the articles downstream of said rear flap folding means.

3. The packaging machine of claim 2, further including feeder means for feeding the tray blanks one at a time onto said tray conveyor means and under said dead plate.

4. The packaging machine of claim 2 wherein said rear flap folding means includes a pair of flap folding devices mounted adjacent said end guides on opposite sides of said tray conveyor means, each of said flap folding devices including a flap folding member pivotally mounted adjacent said end guides about a horizontal pivot axis generally normal to the path along which the loaded tray blank is conveyed and above the plane of the end wall and the unfolded flap, said flap folding member including a curved finger portion extending upstream of said pivot axis and a camming portion extending downstream of said pivot axis, said camming portion defining a lower camming surface thereon and the center of mass of said flap folding member located so as to urge said flap folding member to pivot about said pivot axis to lower said camming surface on said camming portion below the plane of the end wall and the unfolded flap and to raise said finger portion above the plane of the end wall and the unfolded flap so that the leading end of the end wall passes under said finger portion of said flap folding member and engages said camming portion and pivots said flap folding member so as to lower said finger portion toward the end wall so that said finger portion passes through the slot and under the unfolded flap to fold said flap upwardly about a fold line parallel to said prescribed path while leaving said end wall unfolded.

5. The packaging machine of claim 4 wherein each of said flap folding devices further includes a deflector member located adjacent said finger portion of said flap folding member and extending through said opening in said end guide to engage the flap being folded by said flap folding member and deflect the flap through said opening in said end guide to a square condition with respect to the rear flap.

6. The packaging machine of claim 2 wherein said load forming means includes article conveyor means for conveying the articles thereon, lane divider means for dividing the conveyed articles into rows, and grouper means for dividing the rows of articles into subgroups.

7. The packaging machine of claim 6 wherein said lane divider means includes a plurality of lane divider assemblies removably and alternatively positionable adjacent said article conveyor means where different divider assemblies divide the articles into different numbers of rows of articles; and wherein said grouper means includes a plurality of grouper conveyors removably and alternatively positionable adjacent said article conveyor means where one of said grouper conveyors is arranged to cooperate with one of the different lane divider assemblies to divide those rows of articles in said one lane divider assembly into subgroups so that articles can be arranged in different groupings by interchanging one of said divider assemblies along with the grouper conveyor corresponding thereto for another of said lane divider assemblies along with the grouper conveyor corresponding thereto.

8. A machine for arranging articles into groups for packaging comprising:

a support frame;

an infeed conveyor mounted on said support frame defining a smooth transport surface thereon for moving articles thereover in an unordered arrangement;

a plurality of lane conveyors for receiving articles from said infeed conveyor and transporting the articles thereon, said lane conveyors arranged parallel to each other defining spaces therebetween of prescribed widths;

upper divider mounting means including a plurality of upright members on said support frame extending above said infeed and lane conveyors;

a plurality of upper lane divider assemblies removably and alternatively mountable on said upper divider mounting means over said infeed conveyor and said lane conveyors to divide the articles moving along said infeed conveyor into rows aligned with said lane conveyors each of said upper lane divider assemblies including a plurality of upper support members adapted to extend transversally across said infeed and lane conveyors and fixedly yet removably mountable between said upright members, a pair of spaced apart side guide members secured to said upper support members and depending therebelow to extend along said infeed and lane conveyors parallel thereto when said upper support members are mounted in said upright members, and a plurality of spaced apart lane divider plate units secured to said upper support members between said side guide members and depending below said upper support members to extend along said infeed and lane conveyors parallel thereto when said upper support members are mounted in said upright members so that said upper support members, said side guide members and said lane dividers plate units are removable as a unit; said plurality of upper lane divider assemblies including a first upper lane divider assembly including a first plurality of said line divider plate units for dividing the articles on said infeed conveyor into a first prescribed number of rows so that said rows of articles are supported on said lane conveyors without adjustment of the spacing between said lane conveyors, and a second upper lane divider assembly including a second plurality of said lane divider plate units for dividing the articles on said infeed conveyor into a second prescribed number of rows so that said rows of articles are supported on said lane conveyors without adjustment of the spacing between said lane conveyors so that said first and second lane divider assemblies can be interchangeably mounted on said upright members without adjustment of the spacing between said lane conveyors;

grouper conveyor sprocket means including a pair of spaced apart support shafts rotatably mounted on said support frame under said lane conveyors and a pair of spaced apart sprockets mounted on each of said support shafts; and a plurality of grouper conveyors removably and alternatively mountable on said grouper conveyor sprocket means below said lane conveyors each of said grouper conveyors including a pair of spaced apart grouper chains removably mountable around said sprockets and extending between said support shafts, a plurality of grouper flight bars mounted between said grouper chains at spaced apart positions therealong oriented normal to the lane conveyors and passing immediately under said lane conveyors as said flight bars pass along the upper flight of said conveyor chains, and a plurality of holdback members mounted on each of said flight bars adapted to extend up through certain of said spaces between said lane conveyors to engage the articles in the rows carried on said lane conveyors without interference with said lane conveyors and without adjustment of the spacing between said lane conveyors, said plurality of grouper conveyors including a first grouper conveyor adapted to cooperate with said first lane divider assembly and having a first prescribed number of said holdback members on each of said flight bars with a first prescribed spacing therebetween so that said holdback members on said first grouper conveyor extend up through said spaces between said lane conveyors to engage those articles in each row of articles positioned by said first lane divider assembly and subdivide each row of articles into subgroups of articles with a first prescribed spacing therebetween, and a second grouper conveyor adapted to cooperate with said second lane divider assembly and having a second prescribed number of said holdback members on each of said flight bars with a second prescribed spacing therebetween so that said holdback members on said second grouper conveyor extend up through said spaces between said lane conveyors to engage those articles in each row of articles positioned by said second lane divider assembly and subdivide each row of articles into subgroups of articles with a second prescribed spacing therebetween so that said first and second grouper conveyors can be interchangeably mounted on said upright members without adjustment of the spacing between said lane conveyors.

9. The machine of claim 8 further including:

lower divider mounting means; and a plurality of lower lane divider assemblies removably and alternatively mountable on said lower mounting means within said spaces between said lane conveyors where one of said lower lane divider assemblies cooperates with one of said upper lane divider assemblies to maintain the articles in the same rows as divided by said one upper lane divider assembly and each such row aligned with said one of said lane conveyors so that articles can be arranged in different groupings by interchanging one of said upper lane divider assemblies along with the grouper conveyor and lower lane divider assembly corresponding thereto for another of said upper lane divider assemblies along with the grouper conveyor and lower lane divider assembly corresponding thereto.

10. A flap folding device for folding a flap on a tray blank without folding the end wall on the tray blank coplanar with the flap and separated therefrom by a slot comprising:

conveyor means for moving the tray blank along a prescribed horizontal path with the end wall and unfolded flap coplanar with each other and with the unfolded flap trailing the end wall;

a flap folding member pivotally mounted adjacent said conveyor means about a horizontal pivot axis generally normal to said prescribed path and above the plane of the end wall and the unfolded flap, said flap folding member including a curved finger portion extending upstream of said pivot axis and a camming portion extending downstream of said pivot axis, said camming portion defining a lower camming surface thereon and the center of mass of said flap folding member located so as to urge said flap folding member to pivot about said pivot axis to lower said camming surface on said camming portion below the plane of the end wall and the unfolded flap and to raise said finger portion above the plane of the end wall and the unfolded flap so that the leading end of the end wall passes under said finger portion of said flap folding member and engages said camming surface on said camming portion and pivots said flap folding member so as to lower said finger portion against the end wall and resiliently urge said finger portion down against the end wall so that said finger portion is pressed through the slot and under the unfolded flap to fold said flap upwardly about a fold line parallel to said prescribed path.

11. The flap folding device of claim 10 further including a deflector member located against said finger portion of said flap folding member so that the end wall passes thereunder without engaging same while said finger portion folds the flap up into engagement with said deflector member and said deflector member continues to fold the flap into a position perpendicular to the end wall.

* * * * *